US012692036B2

(12) United States Patent
Barnholtz et al.

(10) Patent No.: US 12,692,036 B2
(45) Date of Patent: Jul. 28, 2026

(54) METHODS FOR IMPROVING UNIT LOAD EFFICIENCY

(71) Applicant: The Procter & Gamble Company, Cincinnati, OH (US)

(72) Inventors: Steven Lee Barnholtz, West Chester, OH (US); Andrew D. Biddle, Cincinnati, OH (US); Nathalia Pelaez, Cincinnati, OH (US); Jessica G. Capone, Cincinnati, OH (US); Jose A. Mercado, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 19/231,845

(22) Filed: Jun. 9, 2025

(65) Prior Publication Data

US 2025/0376286 A1 Dec. 11, 2025

Related U.S. Application Data

(60) Provisional application No. 63/658,130, filed on Jun. 10, 2024.

(51) Int. Cl.

| | |
|---|---|
| ***B65B 63/02*** | (2006.01) |
| ***B65B 11/02*** | (2006.01) |
| ***B65B 25/14*** | (2006.01) |
| ***B65B 35/50*** | (2006.01) |

(52) U.S. Cl.
CPC ..... *B65B 63/02* (2013.01); *B65B 11/025* (2013.01); *B65B 25/146* (2013.01); *B65B 35/50* (2013.01)

(58) Field of Classification Search
None
See application file for complete search history.

(56) References Cited

U.S. PATENT DOCUMENTS

| | | | | |
|---|---|---|---|---|
| 3,429,095 | A * | 2/1969 | Huson | B65B 63/028 53/436 |
| 5,893,258 | A * | 4/1999 | Lancaster, III | B65B 11/045 53/529 |
| 11,667,446 | B2 * | 6/2023 | Green | B65D 71/0088 206/597 |
| 2009/0293431 | A1 * | 12/2009 | Andria | B65B 31/06 53/436 |
| 2016/0137398 | A1 * | 5/2016 | Lemke | B65D 77/02 206/391 |

* cited by examiner

*Primary Examiner* — Tanzim Imam
(74) *Attorney, Agent, or Firm* — Richard L. Alexander

(57) ABSTRACT

A method for increasing unit load efficiency may include providing a pallet, forming a stack on the pallet, and wrapping the stack with an elastically deformable substrate under an applied force to reduce one or more of an initial maximum stack length to a compressed maximum stack length or an initial maximum stack width to a compressed maximum stack width. Upon compression the compressed maximum stack length may be from about 1% to about 10% greater than the pallet length, and the compressed maximum stack width may be from about 1% to about 15% greater than the pallet width.

20 Claims, 26 Drawing Sheets

METHODS FOR IMPROVING UNIT LOAD EFFICIENCY

CROSS REFERENCE TO RELATED APPLICATION

This application claims the benefit of U.S. Provisional Application No. 63/658,130, filed Jun. 10, 2024, the substance of which is incorporated herein by reference.

FIELD

The present disclosure relates generally to increasing unit load efficiency and more specifically to increasing unit load efficiency of packs of rolled paper products stacked on pallets.

BACKGROUND

Increasing shipping efficiency requires fitting more product per pallet and/or per truckload. Increasing shipping efficiency positively impacts production costs and improves sustainability by reducing fuel consumption. Moreover, some retailers, particularly wholesale price clubs, sell product directly from a pallet so the amount of product on a pallet impacts the available product to sell. More product per pallet also reduces "out of stock" situations while reducing the frequency at which employees must restock empty pallet positions. Thus, it is highly desirable to increase shipping efficiency by fitting more product per pallet and/or per truckload. However, a contradiction exists between a customer desire for large rolls and large packs with how many packs can be placed on a given pallet dimension. Standard pallet dimensions (40×48") offer efficiency for truck loading but some amount of product may "overhang" from the outer dimension of the pallet and still successfully fit in, and fill, the truck with minimal risk to product damage. The outer dimensions previously found to be the maximum for the overhung pallet for some products is about 43.5"x about 49.5". It is to be appreciated that different products may function with different degrees of overhang. The 49.5" dimension allows the truck to be filled with two pallets side-by-side (wide dimension to wide dimension) simultaneously through the truck opening, for other products, the 49.5" value may be extended to 50.0" or even to 51". The 43.5" dimension allows the length of the truck to be filled with 15 unit loads front to back. Dimensions larger than this require reducing the number of unit loads in the truck, which may reduce shipping efficiency. A need exists for a method of fitting more product per pallet and/or per truckload without reducing the final size of rolls or packs and without exceeding the allowable overhang beyond the width and length of a standard pallet.

The discussion of shortcomings and needs existing in the field prior to the present disclosure is in no way an admission that such shortcomings and needs were recognized by those skilled in the art prior to the present disclosure.

SUMMARY

Various embodiments solve the above-mentioned problems and relate to a method for increasing unit load efficiency. The method may include providing a pallet, forming a stack of packages on the pallet, and wrapping the stack with an elastically deformable substrate under an applied force to secure the stack to the pallet, thereby forming a unit load comprising, the pallet, the stack of packages, and the elastically deformable substrate. The pallet may have a pallet length along a pallet longitudinal axis and a pallet width along a pallet lateral axis. The stack may comprise a plurality of packages. The stack may have an initial maximum stack length along the pallet longitudinal axis and an initial maximum stack width along the pallet lateral axis, where the initial maximum stack length and the initial maximum stack width are measured using the Stack Measurement Method. The step of wrapping the stack with the elastically deformable substrate under the applied force may reduce one or more of the initial maximum stack length to a compressed maximum stack length along the pallet longitudinal axis and the initial maximum stack width to a compressed maximum stack width along the pallet lateral axis, where the compressed maximum stack length and the compressed maximum stack width are measured using the Stack Measurement Method. It is to be appreciated that a force may be applied in a variety of ways and that the elastically deformable substrate need not always be used to apply the force. For example, the stack may be wrapped after a force is applied by other mechanical means, in which case the elastically deformable substrate may maintain the stack in a compressed state.

The initial stack dimensions may be compared to the pallet dimensions. The initial maximum stack length, in an uncompressed state, may be from about 2% to about 20% greater than the pallet length. The initial maximum stack width, in an uncompressed state, may be from about 2% to about 20% greater than the pallet width.

The compressed stack dimensions may be compared to the pallet dimensions. The compressed maximum stack length may be from about 1% to about 10% greater than the pallet length. The compressed maximum stack width may be from about 1% to about 15% greater than the pallet width.

For example, according to various embodiments, the pallet length may be about 48 inches (121.92 cm), the pallet width may be about 40 inches (101.6 cm), the compressed maximum stack length may be less than or equal to about 49.5 inches (125.73 cm), and the compressed maximum stack width may be less than or equal to about 43.5 inches (110.49 cm).

The stack may comprise any number of packages, depending on the size of the packages. For example, with respect to packages comprising rolled paper products, the stack may comprise from 10 to 60 packages. Forming the stack on the pallet may comprise arranging the plurality of packages in a plurality of layers. According to some embodiments, each of the plurality of packages may have a package perimeter comprising a package length along a package longitudinal axis and a package width along a package lateral axis. The package length may be greater than or equal to the package width. The plurality of packages may comprise at least a first package and a second package, and wherein forming the stack on the pallet comprises substantially aligning the package longitudinal axis of the first package with the pallet longitudinal axis and substantially aligning the package lateral axis of the second package with the pallet lateral axis.

The method may also be calibrated to allow one or more of the compressed maximum stack length and the compressed maximum stack width to return to within 95% to 100% of the respective initial maximum stack length and initial maximum stack width upon removal of the elastically deformable substrate. Additionally or alternatively, the method may be calibrated to allow one or more of the compressed maximum stack length and the compressed maximum stack width to return to within 95% to 100% of the respective initial maximum stack length and initial maximum stack width upon removal of the elastically deformable substrate.

According to various embodiments, each of the plurality of packages may comprise a plurality of rolled paper products. The plurality of packages comprises at least a first package and a second package, and forming the stack on the pallet may comprise offsetting the plurality of rolled paper products in the first package relative to the plurality of rolled paper products in the second package to form at least one offset zone, described in greater detail hereinafter. Generally, an offset zone is intended to prevent excessive overhang in regions where the applied force of the elastically deformable material is at local minima. According to some embodiments, the step of wrapping the stack with the elastically deformable substrate under the applied force does not compress any of the plurality of rolled paper products beyond a point at which the rolled paper products are permanently crushed. According to some embodiments, the step of wrapping the stack with the elastically deformable substrate under the applied force compresses a limited number of the plurality of rolled paper products beyond a point at which the rolled paper products are permanently crushed. As a non-limiting example, the limited number may be in a range of from 1 to 10 or 1 to 50. Additionally or alternatively, the limited number may represent from 1 to 10% of the total number of rolled paper products contained within the unit load.

Various embodiments relate to a unit load comprising a pallet, a stack disposed on the pallet, the stack comprising a plurality of packages, and an elastically deformable substrate wrapped around at least the stack to apply a force thereto. According to some embodiments, the elastically deformable substrate may also wrap around the pallet. The elastically deformable substrate may compress the stack such that upon removal of the elastically deformable substrate, at least one dimension of the stack increases. The at least one dimension may be a stack length, a stack width, a stack perimeter, or any combination thereof. Each of the plurality of packages may comprise any type of product, including but not limited to rolled paper product. The rolled paper product may be, for example, kitchen towels and/or bathroom tissue.

Various embodiments may relate to a unit load including a pallet and a stack disposed on the Pallet. The stack may include a plurality of packages. The stack may also include a top and bottom end spaced apart along a longitudinal axis and a left and right side spaced apart along a lateral axis. An elastically deformable substrate may be wrapped around at least the stack to apply a force thereto. The elastically deformable substrate may form an arc along an outer surface along the top and bottom end of the stack such that a maximum length of the stack along the longitudinal axis is greater between the left and right side of the stack than at the left and right side of the stack. An offset zone may be created within the stack based on the applied force that forms the arc along the outer surface of the top and bottom end of the stack. Upon removal of the elastically deformable substrate, at least one dimension of the stack may increase. The maximum length of the stack along the longitudinal axis may be greater than a length of the pallet along the longitudinal axis such that the top end of the stack forms a top overhang over a top side of the pallet and the bottom end of the stack forms a bottom overhang over a bottom side of the pallet.

Various embodiments may relate to a method for positioning a plurality of unit loads into a bed of a vehicle. The method may include a step of providing one or more pairs of unit loads, where each pair of the unit loads may include a first unit load and a second unit load. For each of the pairs of unit loads, the method may include a step of inserting a first pair of forks of a forklift machine through a pair of openings defined by a pallet of the first unit load and may also include a step of inserting a second pair of forks of the forklift machine through a pair of openings defined by a pallet of the second unit load. For each of the pairs of unit loads, the method may include a step of moving the first pair of forks and the second pair of forks together to reduce the top overhang in the first unit load and to reduce the bottom overhang in the second unit load and reduce a sum of a maximum stack length along the longitudinal axis of the first unit load and the second unit load from a first value to a second value. The maximum stack length may be measured using the Stack Measurement Method. For each of the pairs of unit loads, the method may include a step of moving the first pair of forks and the second pair of forks to move the first unit load and the second unit load through an opening defined by the vehicle, where an inner dimension of the opening is less than the second value of the sum of the maximum stack length. For each of the pairs of unit loads, the moving step may involve a step of inwardly compressing, with surfaces of the vehicle forming the opening, the stack of the first unit load and the second unit load based on the offset zone created within the stack such that the sum of the maximum stack length is reduced from the second value to a third value. The third value of the sum of the maximum stack length may be equal to or less than the inner dimension of the opening. For each of the pairs of unit loads, upon moving the stack of the first unit load and the second unit load through the opening and into the bed of the vehicle, the method may include a step of outwardly expanding the stack of the first unit load and the second unit load such that the sum of the maximum stack length increases from the third value to the second value. For each of the pairs of unit loads, the method may include a step of moving the first pair of forks and the second pair of forks apart to increase the top overhang in the first unit load and increase the bottom overhang in the second unit load such that the sum of the maximum stack length increases from the second value to the first value. An interior width dimension within the bed of the vehicle may be greater than the first value of the sum of the maximum stack length.

These and other features, aspects, and advantages of various embodiments will become better understood with reference to the following description, figures, and claims.

BRIEF DESCRIPTION OF THE DRAWINGS

Many aspects of this disclosure can be better understood with reference to the following figures, which illustrate examples according to various embodiments.

Figure 1:
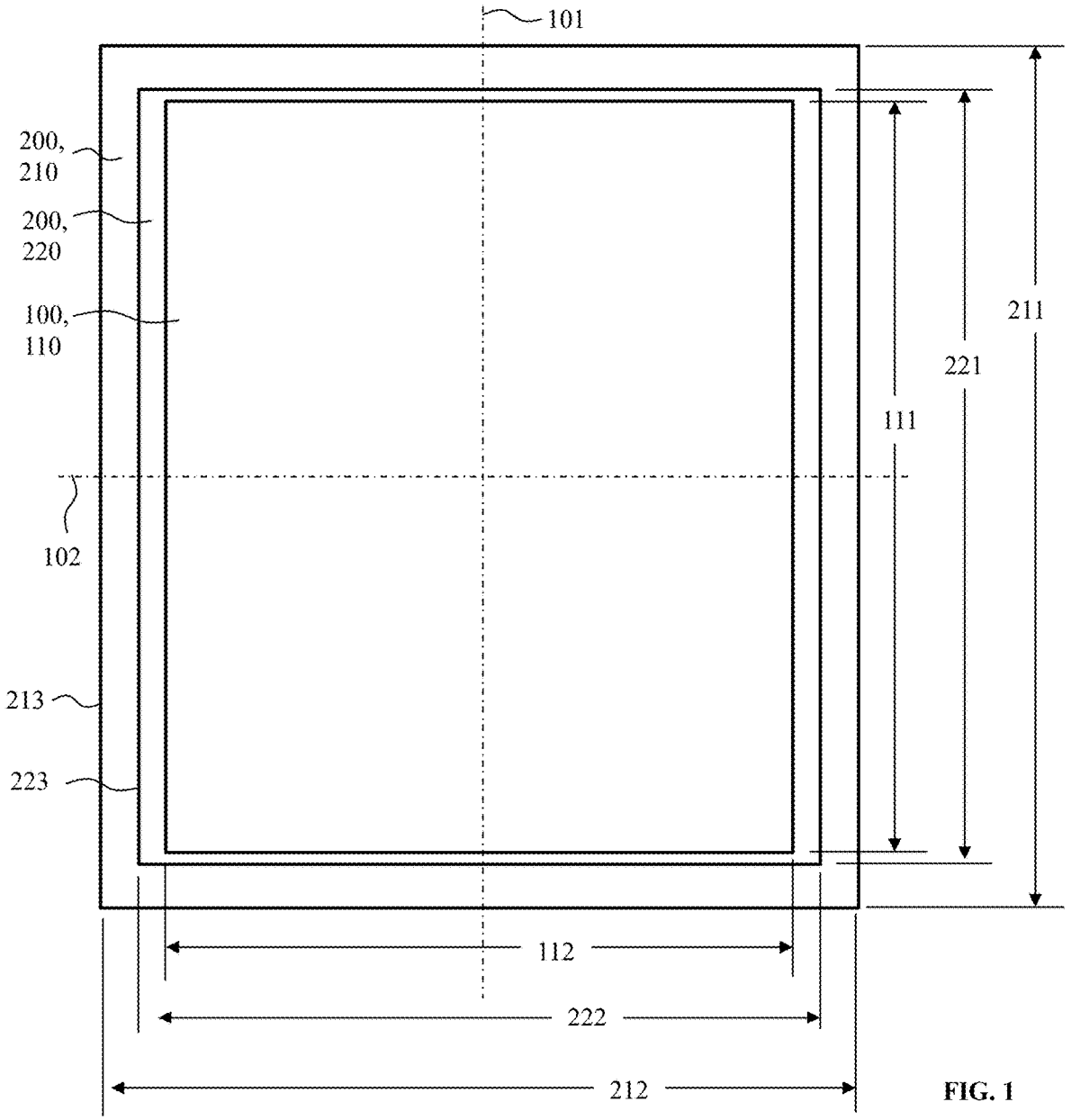
FIG. 1 is a schematic top view of the perimeters of a pallet and a stack in an initial and a compressed configuration.

It should be understood that the various embodiments are not limited to the examples illustrated in the figures.

DETAILED DESCRIPTION

Introduction and Definitions

This disclosure is written to describe the invention to a person having ordinary skill in the art, who will understand that this disclosure is not limited to the specific examples or embodiments described. The examples and embodiments are single instances of the invention which will make a much larger scope apparent to the person having ordinary skill in the art. Unless defined otherwise, all technical and scientific terms used herein have the same meaning as commonly understood by the person having ordinary skill in the art. It is also to be understood that the terminology used herein is for the purpose of describing examples and embodiments only, and is not intended to be limiting, since the scope of the present disclosure will be limited only by the appended claims.

All the features disclosed in this specification (including any accompanying claims, abstract, and drawings) may be replaced by alternative features serving the same, equivalent, or similar purpose, unless expressly stated otherwise. Thus, unless expressly stated otherwise, each feature disclosed is one example only of a generic series of equivalent or similar features. The examples and embodiments described herein are for illustrative purposes only and that various modifications or changes in light thereof will be suggested to the person having ordinary skill in the art and are to be included within the spirit and purview of this application. Many variations and modifications may be made to the embodiments of the disclosure without departing substantially from the spirit and principles of the disclosure. All such modifications and variations are intended to be included herein within the scope of this disclosure. For example, unless otherwise indicated, the present disclosure is not limited to particular materials, reagents, reaction materials, manufacturing processes, or the like, as such can vary. It is also to be understood that the terminology used herein is for purposes of describing particular embodiments only and is not intended to be limiting. It is also possible in the present disclosure that steps can be executed in different sequence where this is logically possible.

All numeric values are herein assumed to be modified by the term "about," whether or not explicitly indicated. The term "about" generally refers to a range of numbers that one of skill in the art would consider equivalent to the recited value (for example, having the same function or result). In many instances, the term "about" may include numbers that are rounded to the nearest significant figure. With respect to measurements of distance, "about" generally means plus or minus 0.5 cm.

In everyday usage, indefinite articles (like "a" or "an") precede countable nouns and noncountable nouns almost never take indefinite articles. It must be noted, therefore, that, as used in this specification and in the claims that follow, the singular forms "a," "an," and "the" include plural referents unless the context clearly dictates otherwise. Thus, for example, reference to "a support" includes a plurality of supports. Particularly when a single countable noun is listed as an element in a claim, this specification will generally use a phrase such as "a single." For example, "a single support."

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

In this specification and in the claims that follow, reference will be made to a number of terms that shall be defined to have the following meanings unless a contrary intention is apparent. "Disposed on" refers to a positional state indicating that one object or material is arranged in a position adjacent to the position of another object or material. The term does not require or exclude the presence of intervening objects, materials, or layers.

"Align" or "aligned" or "aligning" means to place or to arrange in a straight line. Aligning axes, therefore, means arranging the axes so that they extend along approximately the same line or along parallel lines. It is to be appreciated that aligning axes can be accomplished in a variety of ways. A first axis and a second axis are "substantially aligned" if any angle between the axis is less than 5 degrees.

"Permanently damaged" or "permanently crushed" refers to a state in which a paper product, such as a rolled paper product, has been compressed or deformed to a point at which the structural integrity, shape, or functionality of the product has been altered beyond at point at which the product would be acceptable to a consumer. This condition may occur due to excessive pressure or mechanical impact, leading to a significant reduction in the thickness and resilience of the paper. The crushed areas may exhibit permanent indentations that do not recover their original form even when the pressure is removed. This alteration may affect the functionality and usability of the paper product.

"Calibrated" refers to adjusting a magnitude of a force applied to a stack, for example, by wrapping the stack with an elastically deformable substrate, to ensure that the products that make up the stack are not permanently damaged, and/or to ensure that the stack may return to a particular dimension, such as a length, width, cross-sectional area, or perimeter, upon removal of the applied force. It is to be appreciated that different products may be able to withstand different amounts of applied force. Furthermore, it has been discovered that different arrangements of products within a stack may allow for different amounts of compressive force to be applied.

Figure 5:
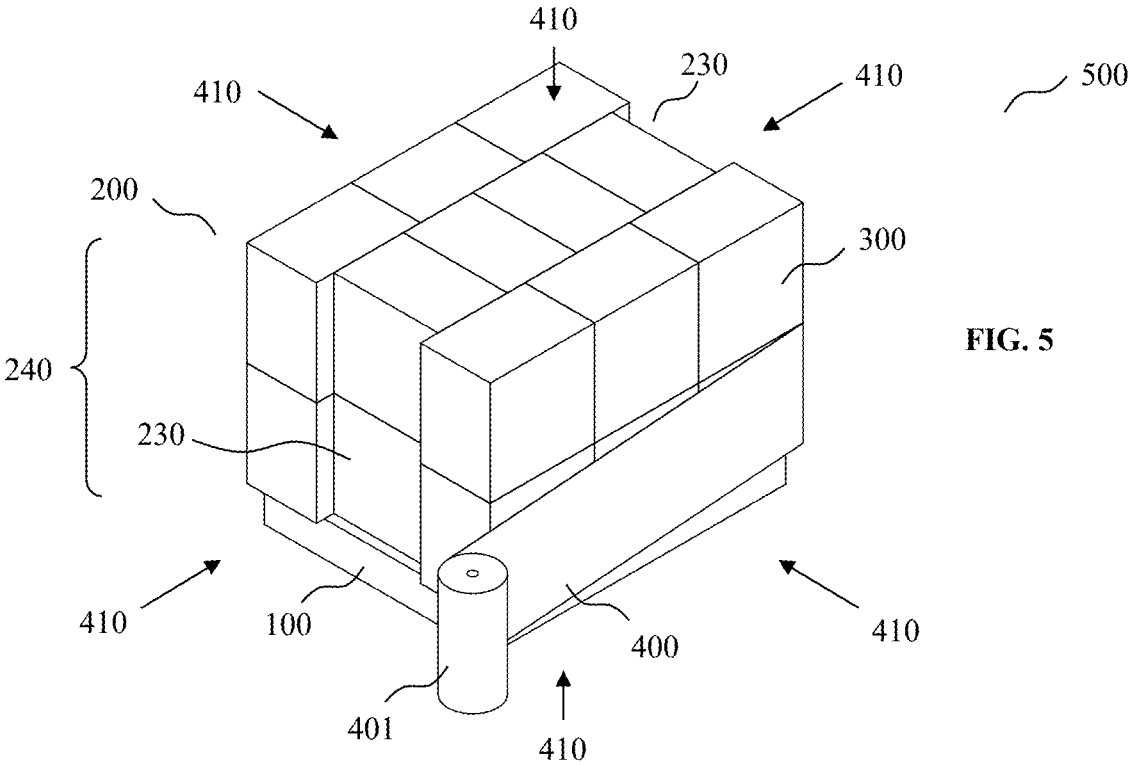
FIG. 5 is a schematic perspective view of a stack on a pallet in the configuration shown in FIG. 4 being wrapped with an elastically deformable substrate to form a unit load.

FIG. 1 is a schematic top view of the perimeters of a pallet 100 and a stack 200 in an initial and in a compressed configuration. The transition from the initial to the compressed configuration may be achieved by applying a force 410, for example by wrapping the stack 200 with an elastically deformable substrate 400, as shown in FIG. 5. The applied force may be measured based on the Containment Force Measurement Method disclosed herein. In one example, the magnitude of the applied force 410 may be in a range from about 9 pounds (lb) to about 22 lb. It is to be appreciated that the force 410 may be applied in a variety of ways and that the elastically deformable substrate 400 need not always be used to apply the force 410. For example, the stack 200 may be wrapped before or after a force 410 is applied by other mechanical means, in which case the elastically deformable substrate 400 may maintain the stack 200 in a compressed state. The pallet 100 may have a pallet longitudinal axis 101 and a pallet lateral axis 102. The pallet longitudinal axis 101 and a pallet lateral axis 102 may be arbitrarily assigned, but, when applicable, the longitudinal axis 101 extends along the longer dimension of the pallet 100 and the lateral axis extends along the shorter dimension of the pallet 100. The longitudinal axis 101 is orthogonal to the lateral axis 102.

The pallet 100 may occupy a pallet perimeter 110 and may have a pallet length 111 and a pallet width 112. As shown in FIG. 1, the pallet length 111 is greater than the pallet width 112. The pallet 100 may have a standard size. For example, the pallet length may be about 48 inches (121.92 cm) and the pallet width may be about 40 inches (101.6 cm).

Figure 2A:
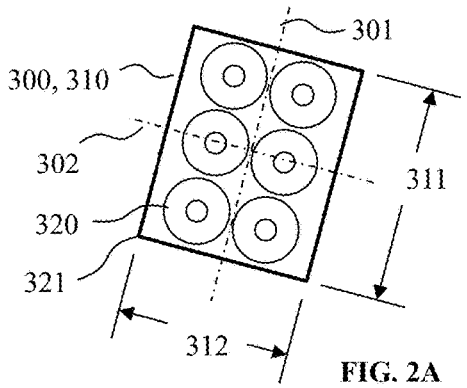
FIG. 2A is a schematic top view of a package having a longitudinal axis that is not substantially aligned with the longitudinal axis of the pallet, shown in FIG. 1.
Figure 2B:
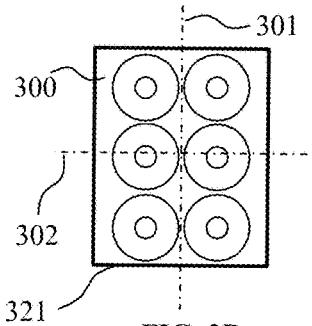
FIG. 2B is a schematic top view of a package having a longitudinal axis that is substantially aligned with the longitudinal axis of the pallet, shown in FIG. 1.
Figure 2C:
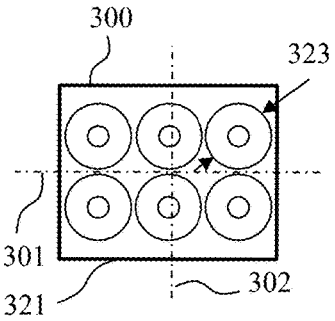
FIG. 2C is a schematic top view of a package having a lateral axis that is not substantially aligned with the longitudinal axis of the pallet, shown in FIG. 1.

FIG. 1 also shows a schematic top view of a stack 200. As will be discussed in greater detail hereinafter, the stack 200 may comprise a plurality of packages 300 (See: FIGS. 2A-2C) each of which may comprise a plurality of products, such as rolled paper products 320. A unit load 500 (see FIG. 5), may include a stack 200 of packages 300 on a pallet 100. The stack 200 may be secured to the pallet 100 by wrapping the stack 200 and optionally a portion of the pallet 100 with an elastically deformable substrate 400.

Figure 9:
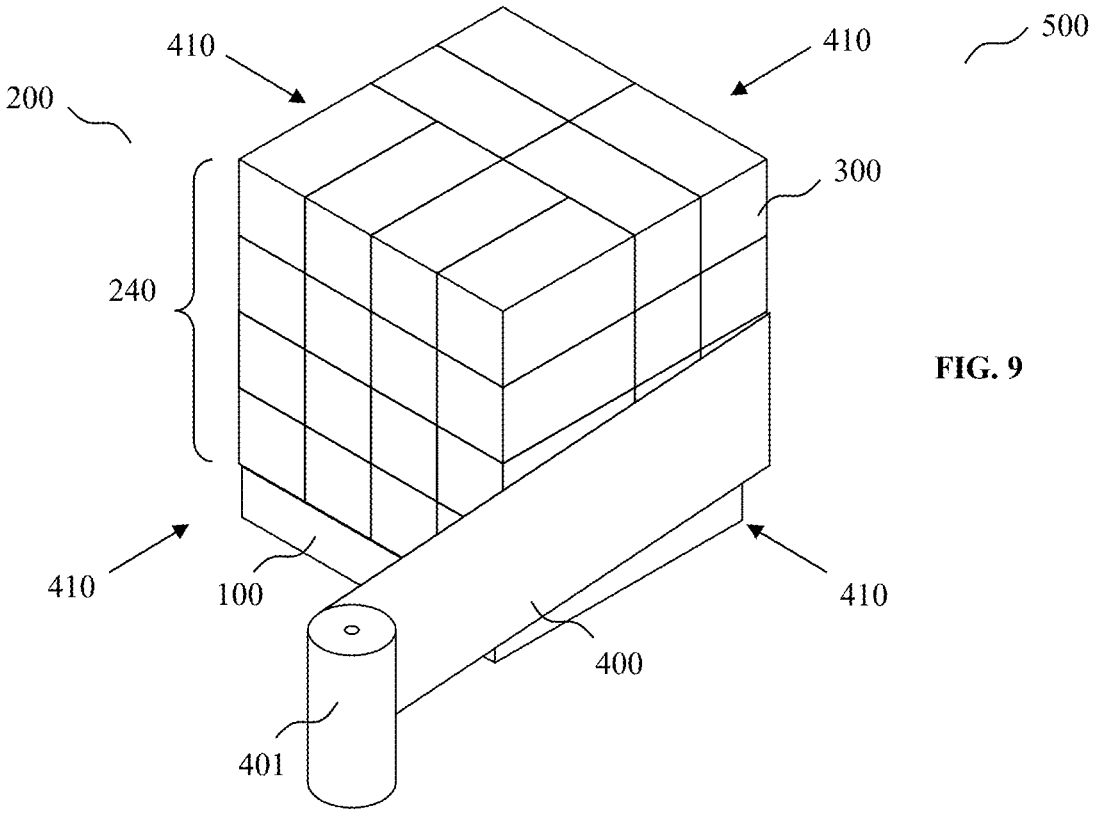
FIG. 9 is a schematic perspective view of a stack on a pallet in the configuration shown in FIG. 8 being wrapped with an elastically deformable substrate to form a unit load.

A stack 200 may occupy an initial stack perimeter 210. The term "initial" as used herein is intended to convey a dimension or a state prior to application of a force 410 (See: FIG. 5, FIG. 9, and/or FIG. 11). The stack 200 may have an initial maximum stack length 211 and an initial maximum stack width 212. The initial stack perimeter 210 may be measured based on the Perimeter Measurement Method disclosed herein. The initial maximum stack length 211 and the initial maximum stack width 212 may be measured based on the Stack Measurement Method disclosed herein. The stack 200 may "overhang" the pallet 100, in other words, the initial stack perimeter 210 may be greater than the pallet perimeter 110, the initial maximum stack length 211 may be greater than the pallet length 111, and/or the initial maximum stack width 212 may be greater than the pallet width 112. The perimeter may be determined by first identifying the intersecting plane through which the cross-section is measured. The dimensions of each package intersected by this plane may then be measured, taking into account any irregular stacking pattern or arrangement. The perimeter for each package section within the plane may be calculated, and these individual perimeters may be aggregated to obtain the total perimeter. This method allows for an accurate determination of the perimeter despite an uneven arrangement of the packages.

As previously discussed, for purposes of efficiently loading a truck with a plurality of unit loads 500, the maximum extent to which a stack 200 or any other aspect of each unit load 500 may overhangs the pallet 100 was determined to be about 43.5 inches (110.49 cm) by about 49.5 inches (125.73 cm). The 49.5" dimension allows the truck to be filled with two unit loads 500 side-by-side (wide dimension to wide dimension) simultaneously through the truck opening. The 43.5" dimension allows the length of the truck to be filled with 15 unit loads front to back. Larger dimensions have also been successfully employed, including dimensions of 50 inches (127 cm) to 51 inches (129.54 cm). Is to be appreciated that this 43.5" dimension does require some pallet-to-pallet compression as the unit loads 500 are loaded and so may not be applicable to unit loads 500 comprising rigid stacks 200. Dimensions larger than this require reducing the number of unit loads 300 in the truck, which may reduce shipping efficiency. It has been discovered that the initial stack perimeter 210, the initial maximum stack length 211, and/or the initial maximum stack width 212 may be larger than the above-mentioned maximum dimensions of a stack 200 that overhangs a pallet 100, if a force 410 is applied to the stack via an elastically deformable substrate 400. If the applied force 410 is selected to avoid permanently crushing or otherwise damaging the products, such as rolled paper products 320, in the unit loads 300, then it is possible, according to various embodiments, to increase the number of unit loads 300 on a pallet 100 without negatively impacting product performance. The product performance of paper products, such as paper towels or toilet tissue, may be negatively impacted by crushing or the application of pressure or force sufficient to affect the product's thickness or absorbency. Such deformation can lead to a reduction in the product's structural integrity, resulting in diminished absorbency and reduced durability. Additionally, the texture and softness of the paper may be compromised, and there may be an increase in the likelihood of tearing or shredding during use. External factors such as excessive stacking, improper packaging, and transportation-related compression can also contribute to these performance issues. In one example, a compressibility of the products, such as the rolled paper products 320, may be in a range from about 13% to about 15%, where the compressibility of the products is measured based on the Product Compressibility Measurement Method disclosed herein.

Still referring to FIG. 1, after application of the force 410, the stack 200 may have a compressed stack perimeter 220, a compressed maximum stack length 221, and a compressed maximum stack width 222 at or within the maximum dimensions previously described. The compressed stack perimeter 220 may be measured based on the Perimeter Measurement Method disclosed herein. The compressed maximum stack length 221 and the compressed maximum stack width 222 may be measured based on the Stack Measurement Method disclosed herein. For example, the compressed maximum stack length 221 may be less than or equal to about 49.5 inches (125.73 cm), and the compressed stack width 222 may be less than or equal to about 43.5 inches (110.49 cm).

The initial stack dimensions may be compared to the pallet dimensions. For example, according to various embodiments, the initial maximum stack length, in an uncompressed state, may be greater than the pallet length by about 2% to about 20%, or about 3% to about 19%, or about 4% to about 18%, or about 5% to about 17%, or about 6% to about 16%, or about 7% to about 15%, or about 8% to about 14%, or about 9% to about 13%, or about 10% to about 12%, or about 11%. The initial maximum stack width, in an uncompressed state, may be greater than the pallet width by about 2% to about 20%, or about 3% to about 19%, or about 4% to about 18%, or about 5% to about 17%, or about 6% to about 16%, or about 7% to about 15%, or about 8% to about 14%, or about 9% to about 13%, or about 10% to about 12%, or about 11%.

The compressed stack dimensions may be compared to the pallet dimensions. For example, according to various embodiments, the compressed maximum stack length 221 may be greater than the pallet length by about 1% to about 15%, or about 2% to about 14%, or about 3% to about 13%, or about 4% to about 12%, or about 5% to about 11%, or about 6% to about 10%, or about 7% to about 9%, or about 8%. The compressed maximum stack width may be greater than the pallet width by about 1% to about 15%, or about 2% to about 14%, or about 3% to about 13%, or about 4% to about 12%, or about 5% to about 11%, or about 6% to about 10%, or about 7% to about 9%, or about 8%.

The force 410 that may be applied may vary based on the particular type of product contained within the packages 300 of a stack 200 and may be readily ascertained by applying a compressive force 410 to determine the point at which the product is damaged. Similarly, the maximum initial stack perimeter 210, the maximum initial stack length 211, and/or the maximum initial stack width 212 for a given type of product or, more precisely, for a stack 200 of packages 300 comprising a given type of product may be readily ascertained by providing stacks 200 having various initial stack perimeters 210, initial maximum stack lengths 211, and/or the initial maximum stack widths 212 and then by applying a force 410 to stacks 200 to achieve a dimension within the above-mentioned maximum dimensions for a stack 200 that overhangs the pallet 100, i.e., within 43.5 inches (110.49 cm) by 49.5 inches (125.73 cm). After the applied force 410 is released, for example by removing the elastically deformable substrate 400, the state of the product within the packages 300 may be evaluated and the maximum initial stack perimeter 210, the maximum initial stack length 211, and/or the maximum initial stack width 212 for a given type of product will be determined.

A force gauge may employed to measure the applied force. Under normal operating conditions, the applied force ranges from about 4 to about 7 pounds. According to various embodiments, the applied force may be increased to exceed 10 pounds and may reach up to about 17 pounds.

According to various embodiments, the method may be calibrated to allow the stack to return to within about 95% to about 100%, or about 96% to about 99%, or about 97 to about 98% of the initial stack perimeter 210 upon removal of the elastically deformable substrate 400. Additionally or alternatively, the method may be calibrated to allow the stack to return to within about 95% to about 100%, or about 96% to about 99%, or about 97 to about 98% of the initial maximum stack length 211 upon removal of the elastically deformable substrate 400. Additionally or alternatively, the method may be calibrated to allow the stack to return to within about 95% to about 100%, or about 96% to about 99%, or about 97 to about 98% of the initial maximum stack width 212 upon removal of the elastically deformable substrate 400. As shown in FIG. 1, the stack 200 may have an initial stack perimeter 213 and a compressed stack perimeter 223. The perimeter of a stack 200 of packages 300 may be defined as the total distance around the outer edges of the stack 200. This measurement may be obtained by summing the lengths of all sides of the stack 200. Alternatively, this measurement may be obtained by wrapping a cord or a rope or a flexible tape measure snuggly around the stack 200. This measurement may be utilized for space planning and organizational purposes. The perimeter may be based on a single measurement at a specific height or may be an average of multiple measurements at various locations along the height of the stack. For example, the perimeter may be an average of three measurements at different vertical locations on the stack. The first location may be about 2 inches (5.08 cm) from top. The second location may be approximately the center of the stack, but preferably above the centerline if the centerline falls between portions of the stack that may be unduly compressed from the measurement, like a space between rolls. The third location may be about 4 inches (10.16 cm) above the bottom of the pallet 100, which corresponds roughly to the bottom of the stack 200.

FIG. 2A is a schematic top view of a package 300 having a longitudinal axis 301 that is not substantially aligned with the longitudinal axis 101 of the pallet 100, shown in FIG. 1. FIG. 2B is a schematic top view of a package 300 having a longitudinal axis 301 that is substantially aligned with the longitudinal axis 101 of the pallet 100, shown in FIG. 1. FIG. 2C is a schematic top view of a package 300 having a lateral axis 302 that is substantially aligned with the longitudinal axis 101 of the pallet 100, shown in FIG. 1. Each package 300 may have a package length 311 and a package width 312. Each package 300 may have a package cross-sectional area 310, which may defined by a wrapper 321 that encloses, protects, and/or secures a plurality of products, such as rolled paper products 320. Examples of rolled paper products may include but are not limited to kitchen towel or bathroom tissue. Each rolled paper product 320 may have a roll diameter 323. Methods according to various embodiments may be utilized to increase the number of packages 300 on a pallet 100 and/or to increase the roll diameter 323 of a rolled paper product 320 while maintaining (or increasing) a given number of packages 300 on a pallet 100. Increasing the roll diameter 323 enables either putting more sheets on a roll or enabling increased caliper of the paper on the roll to drive performance. The roll diameters may vary. For example, the roll diameter may be from about 2 in (5.08 cm) to about 10 in (25.4 cm), or about 2.25 in (5.715 cm) to about 9.75 in (24.765 cm), or about 2.5 in (6.35 cm) to about 9.5 in (24.13 cm), or about 2.75 in (6.985 cm) to about 9.25 in (23.495 cm), or about 3 in (7.62 cm) to about 9 in (22.86 cm), or about 3.25 in (8.255 cm) to about 8.75 in (22.225 cm), or about 3.5 in (8.89 cm) to about 8.5 in (21.59 cm), or about 3.75 in (9.525 cm) to about 8.25 in (20.955 cm), or about 4 in (10.16 cm) to about 8 in (20.32 cm), or about 4.25 in (10.795 cm) to about 7.75 in (19.685 cm), or about 4.5 in (11.43 cm) to about 7.5 in (19.05 cm), or about 4.75 in (12.065 cm) to about 7.25 in (18.415 cm), or about 5 in (12.7 cm) to about 7 in (17.78 cm), or about 5.25 in (13.335 cm) to about 6.75 in (17.145 cm), or about 5.5 in (13.97 cm) to about 6.5 in (16.51 cm), or about 5.75 in (14.605 cm) to about 6.25 in (15.875 cm), or about 6 in (15.24 cm). Some specific examples, include roll diameters of 5.45 inches (13.843 cm), 5.8 inches (14.732 cm), and 6.2 inches (15.748 cm).

Figure 3A:
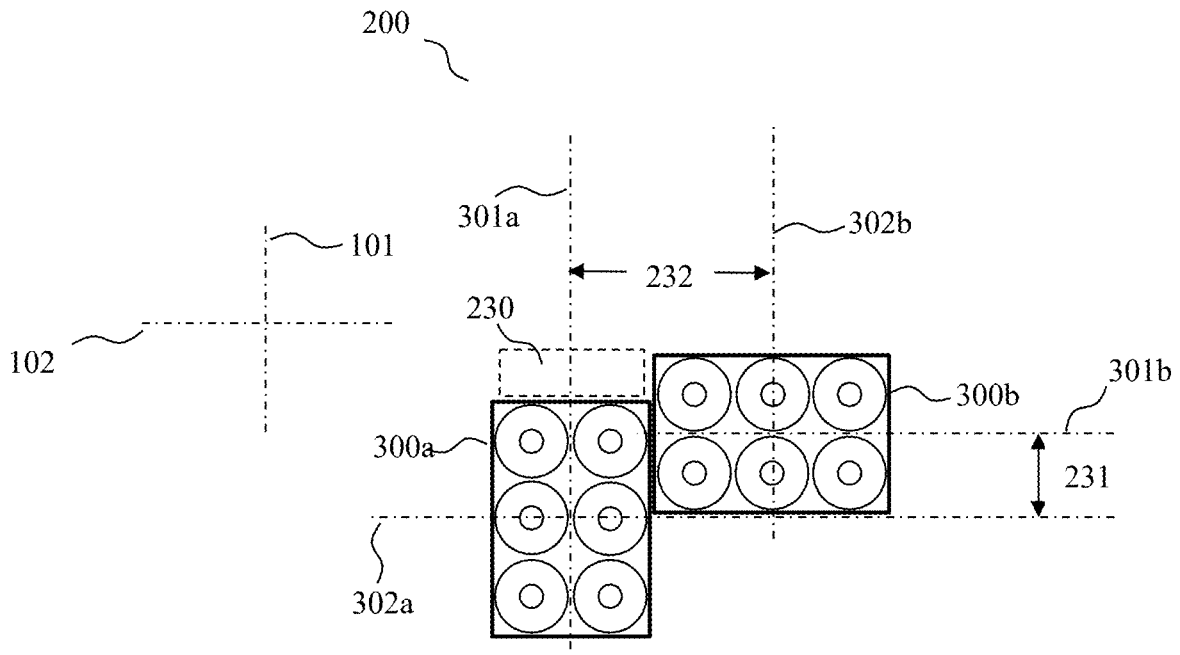
FIG. 3A is a schematic top view of a stack comprising a plurality of packages arranged to include an offset zone.

FIG. 3A is a schematic top view of a stack 200 comprising a plurality of packages 300*a*, 300*b*. The packages 300*a*, 300*b* are arranged to include an offset zone 230. The first package 300*a* is situated such that its package longitudinal axis 301*a* is substantially aligned with a pallet longitudinal axis 101, in that it is substantially parallel therewith. The second package 300*b* is situated such that its package longitudinal axis 301*b* is substantially aligned with a pallet lateral axis 102, in that it is substantially parallel therewith. The offset zone 230 may be described by a longitudinal offset 231 between the package lateral axis 302*a* of the first package 300*a* and the package longitudinal axis 301*b* of the second package 300*b*. The longitudinal offset 231 may extend along to the pallet longitudinal axis 101. The offset zone 230 may be further described by a lateral offset 232 between the package longitudinal axis 301*a* of the first package 300*a* and the package lateral axis 302*b* of the second package 300*b*. The lateral offset 232 may extend along to the pallet lateral axis 101. By arranging the first package 300*a* and the second package 300*b* to have a longitudinal offset 231 along the pallet longitudinal axis 101 and a lateral offset 232 along the pallet lateral axis 102, the offset zone 230 may be created, formed, or defined. The location of the offset zone 230 may be strategically selected within the stack 200 to provide desired longitudinal offset 231 and the desired lateral offset 232.

Figure 3B:
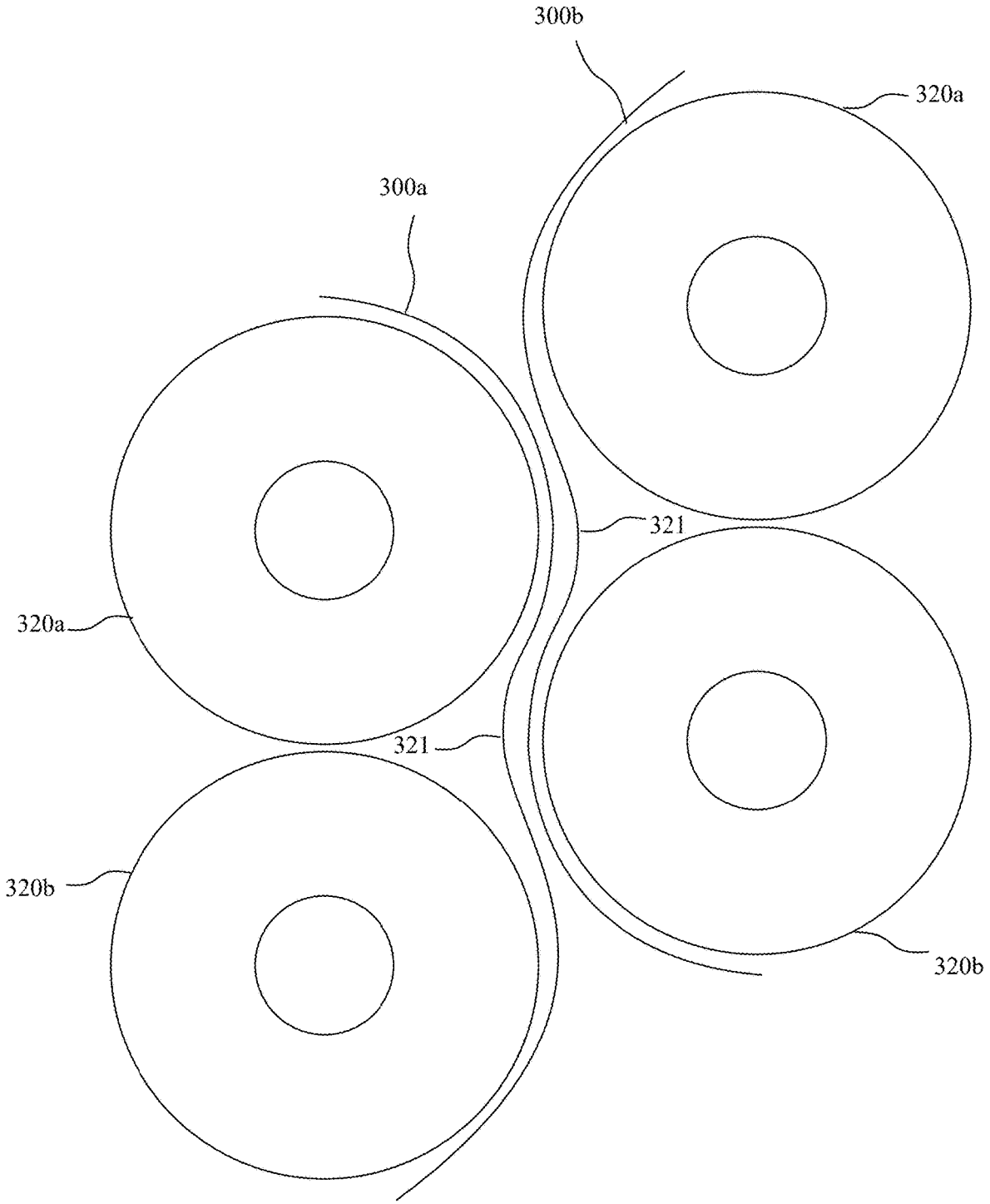
FIG. 3B is a schematic top view of nesting between two packages based on wrapping the stack with an elastically deformable substrate to form a unit load.

FIG. 3B is a schematic top view of nesting between two packages 300*a*, 300*b* based on wrapping the stack with an elastically deformable substrate to form a unit load. As disclosed herein with respect to FIGS. 4 and 7A, in some examples an elastically deformable substrate 400 may be wrapped around the stack 200, so to exert an applied force 410 on the stack 200. FIG. 3B depicts one example of how adjacent packages 300*a*, 300*b* within the stack 200 depicted in FIG. 7A may nest together due to this wrapping of the substrate 400 around the stack 200. For example, as shown in FIG. 3B, in one example, such package to package nesting may involve a first paper product roll 320*a* within a first package 300*a* nesting in a space between two paper product rolls 320*a*, 320*b* of the adjacent package 300*b*. Also, as shown in FIG. 3B, this nesting of the paper product roll 320*a* of the first package 300*a* between the paper product rolls 320*a*, 320*b* of the second package 300*b* may cause deformation 321 in the wrapping of the second package 300*b*. Similarly, as shown in FIG. 3B, the nesting of the paper product roll 320*b* of the second package 300*b* between the paper product rolls 320*a*, 320*b* of the first package 300*a* may cause deformation 321 in the wrapping of the first package 300*a*.

Figure 4:
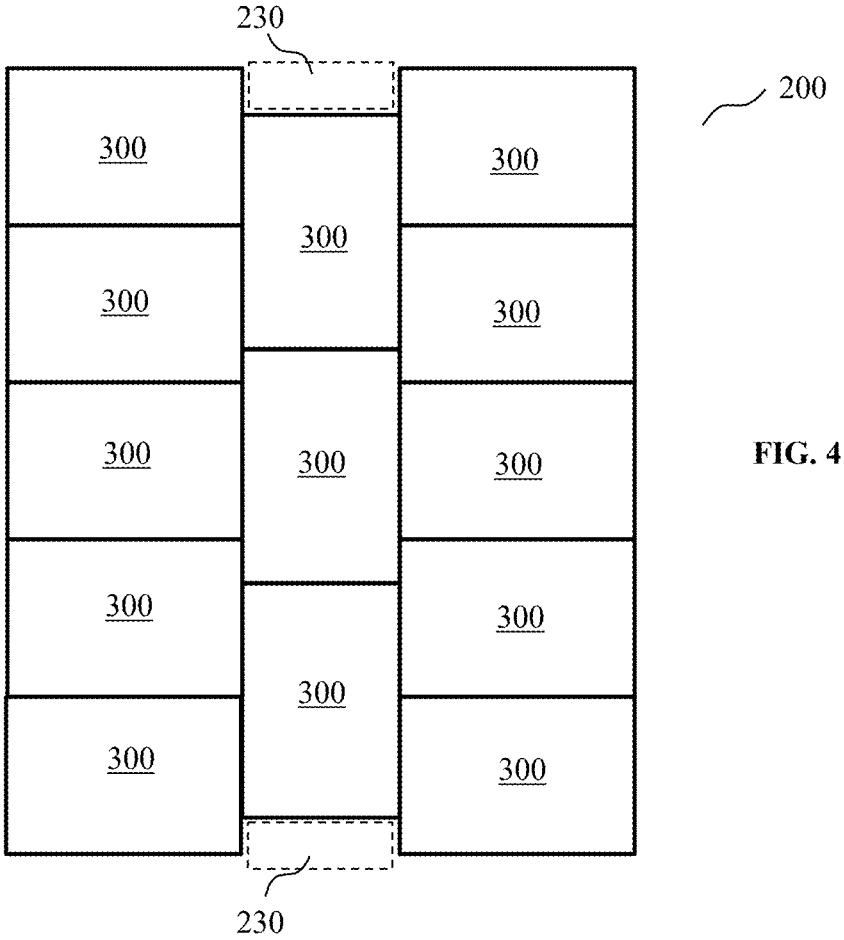
FIG. 4 is a schematic top view of a stack comprising a plurality of package arranged to include an offset zone.

FIG. 4 is a schematic top view of a stack 200 comprising a plurality of packages 300 arranged to include an offset zone 230. FIG. 5 is a schematic perspective view of a stack 200 on a pallet 100 in the configuration shown in FIG. 4 being wrapped with an elastically deformable substrate 400 to form a unit load 500. The stack 200 may include a plurality of layers 240. The elastically deformable substrate 400 may be dispensed from one or more rolls 401 to apply a force 410. Although reference is made herein to a single applied force 410, it is to be appreciated that since the elastically deformable substrate 400 is wrapped around the stack 200 to encircle it, the applied force 410 compresses the stack 200 in all directions around the circumference or perimeter of the stack 200. It may be desirable to apply bands of elastically deformable substrate 400 in particular regions of the height of the unit load to vary the applied force 410 as a function of the height of the unit load. "Bands" refers to a wrap (full circumference) of the unit load 500 of elastically deformable substrate at essentially the same elevation on the unit load. The elastically deformable substrate 400 may be wrapped over the top of the stack 200 and under the pallet to provide applied forces 410 in the z-direction as well. The stack 200 is arranged in an H-shape in FIG. 4, with a pair of offset zones 230. Instead of a pair of offset zones 230, a single offset zone 230 could be provided, such that the stack 200 is arranged in a T-shape. It has been discovered that the T-shaped configuration does not work as well. Without being bound by theory, it is believed that the H-shape configuration distributes the applied force 410 more evenly around the stack than does the T-shape configuration.

Figure 6:
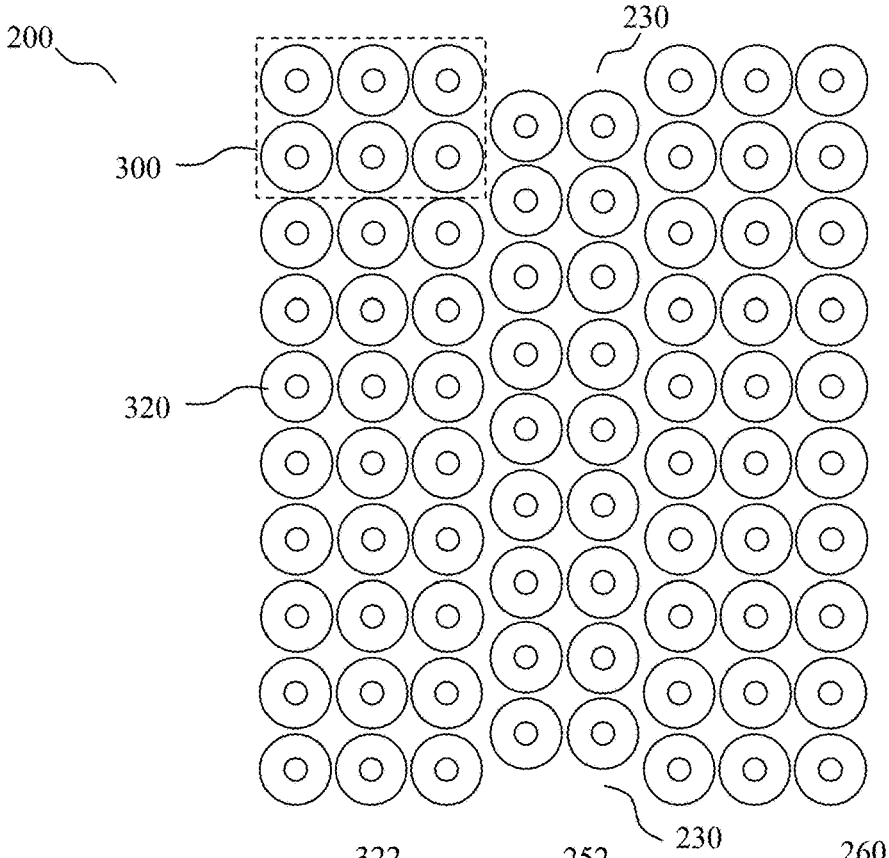
FIG. 6 is a schematic top view of a stack comprising a plurality of package comprising rolled paper products arranged to include an offset zone.
Figure 7A:
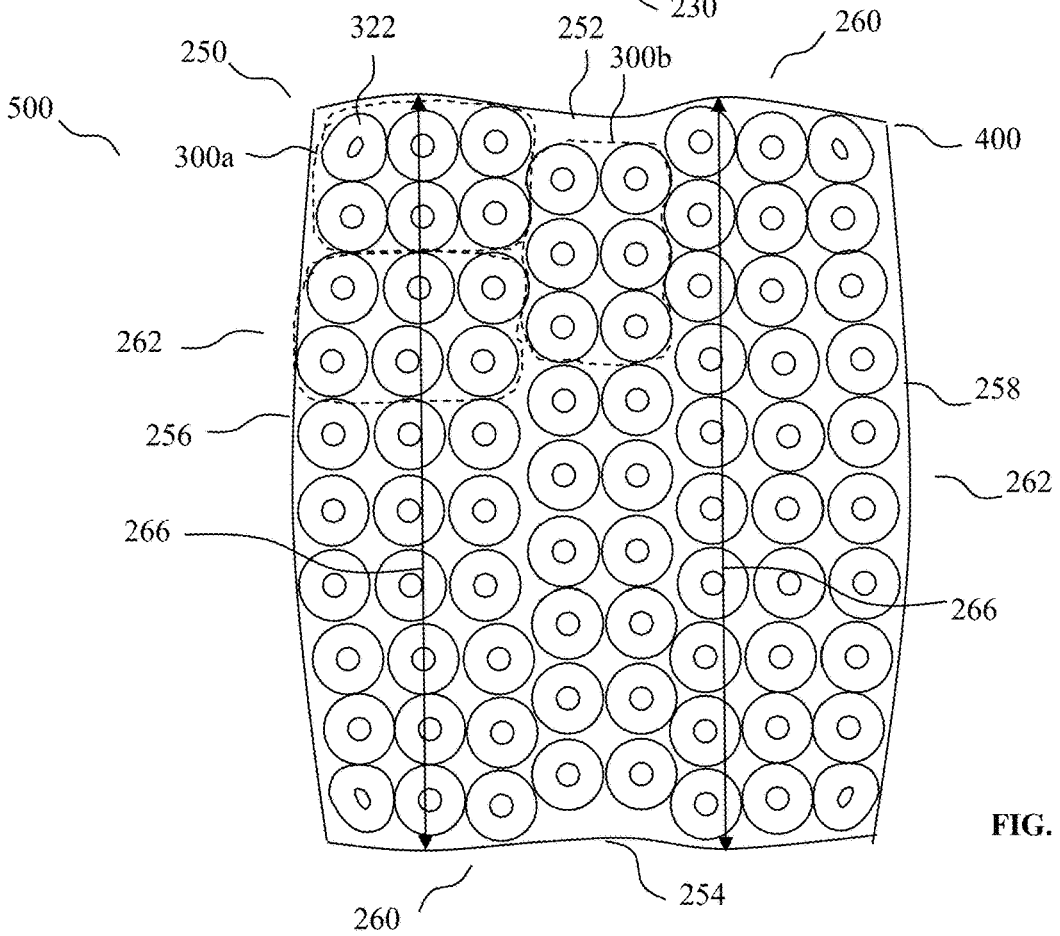
FIG. 7A is a schematic top view of the stack shown in FIG. 6 in a compressed state showing some reversibly compressed rolls and wrapped with an elastically deformable substrate to form a unit load.

FIG. 6 and FIG. 7A cooperate to illustrate the result of applying the force 410 to a stack 200 comprising a plurality of packages 300, each comprising a plurality of rolled paper products 320. More specifically, FIG. 6 is a schematic top view of a stack comprising a plurality of packages 300 comprising rolled paper products 320 arranged to include an offset zone 230. The wrappers 321 of the packages 300 are omitted for simplicity with the exception of one package 300 in the upper left corner. It is to be appreciated that the packages 300 in FIG. 6 and FIG. 7A are arranged in the same configuration as illustrated in FIG. 4 and FIG. 5 and that the stack 200 includes an offset zone 230. FIG. 7A is a schematic top view of the stack shown in FIG. 6 in a compressed state showing some reversibly compressed rolls 322. These reversibly compressed rolls 322 have been deformed by application of the force 410 but are deemed to be "reversibly compressed" because they have not been compressed beyond a point at which they are permanently damaged.

One or more characteristics of the stack in the compressed state is now discussed. In one example, the outer surface of the stack in the compressed state may feature one or more arcs along one or more sides of the stack. These one or more arcs may be formed based on multiple factors, including but not limited to the compressibility of the rolled paper product, the applied force 410 of the elastically deformable substrate 400 wrapped around the stack and the offset zone 230 arranged within the stack. These one or more arcs, combined with the offset zones 230, may facilitate the loading of one or more stacks in the compressed state into areas where the stacks would not otherwise fit, in the absence of the arcs and offset zones 230.

Figure 7B:
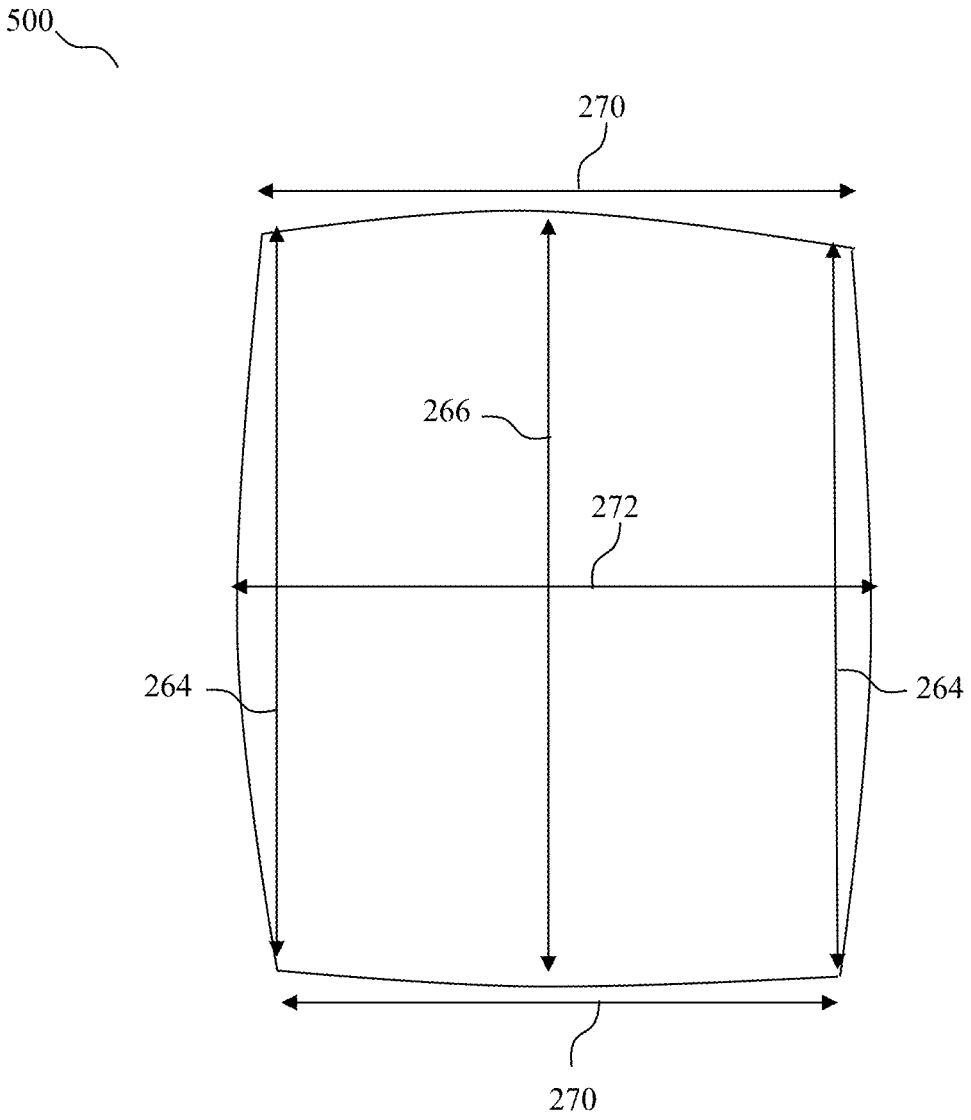
FIG. 7B is a schematic top view of the stack of FIG. 7A without the rolled paper products.

As previously discussed, FIG. 7A is a schematic top view of the stack 200 shown in FIG. 6 in a compressed state showing some reversibly compressed rolls 322 and wrapped with an elastically deformable substrate 400 to form a unit load 500. FIG. 7B is a schematic top view of the stack 200 of FIG. 7A without the rolled paper products 320, for ease of illustration. As shown in FIG. 7A, the stack 200 may include an outer surface 250 along a top end 252 and a bottom end 254 of the stack 200. The top and bottom end 252, 254 of the stack 200 may be spaced apart along the pallet longitudinal axis 101 of the unit load 500. The stack 200 may also include the outer surface 250 along a left side 256 and a right side 258 of the stack 200. The left and right side 256, 258 of the stack 200 may be spaced apart along the pallet lateral axis 102.

As shown in FIG. 7A, by wrapping the elastically deformable substrate 400 around the stack 200, one or more arcs may be formed in the outer surface 250 of the stack 200. In one example, as shown in FIG. 7A, an arc 260 may be formed with the outer surface 250 along the top and bottom end 252, 254 of the stack 200. The arc 260 may be formed based on the compressed stack length having a greater value between the left and right side 256, 258 of the stack 200 than at the left and right side 256, 258 of the stack 200. As shown in FIG. 7B, in this example, the compressed stack length 266 is a maximum value of the stack length between the left and right side 256, 258 of the stack 200 and may be in a range from about 43 inches to about 51 inches. As further shown in FIG. 7B, the compressed stack length 264 is a minimum value of the stack length between the left and right side 256, 258 and may be in a range from about 40 inches to about 50 inches. The compressed minimum stack length 264 may occur at the left and right side 256, 258 of the stack 200 but may also occur at a location other than at the left and right side 256, 258 of the stack 200. As shown in FIG. 7A, the compressed maximum stack length 266 may occur at a location other than a midpoint between the left and right side 256, 258 of the stack 200. As further shown in FIG. 7A, the compressed maximum stack length 266 may occur at more than one location between the left and right side 256, 258 of the stack 200.

In another example, as shown in FIG. 7A, an arc 262 may be formed with the outer surface 250 along the left and right side 256, 258 of the stack 200. The arc 262 may be formed based on the compressed stack width having a greater value between the top and bottom ends 252, 254 of the stack 200 than at the top and bottom ends 252, 254 of the stack 200. As shown in FIG. 7B, in this example, the compressed stack width 272 is a maximum value of the stack width between the top and bottom end 252, 254 of the stack 200 and may be in a range from about 39 inches to about 46 inches. As further shown in FIG. 7B, the compressed stack width 270 is a minimum value of the stack width between the top and bottom end 252, 254 and may be in a range from about 34 inches to about 44 inches. The compressed stack width 270 may occur at the top and bottom end 252, 254 of the stack 200 but may also occur at a location other than at the top and bottom end 252, 254 of the stack 200.

FIG. 3B depicts an example of an interface between the packages 300*a*, 300*b* in the stack 200 of FIG. 7A.

Figure 7C:
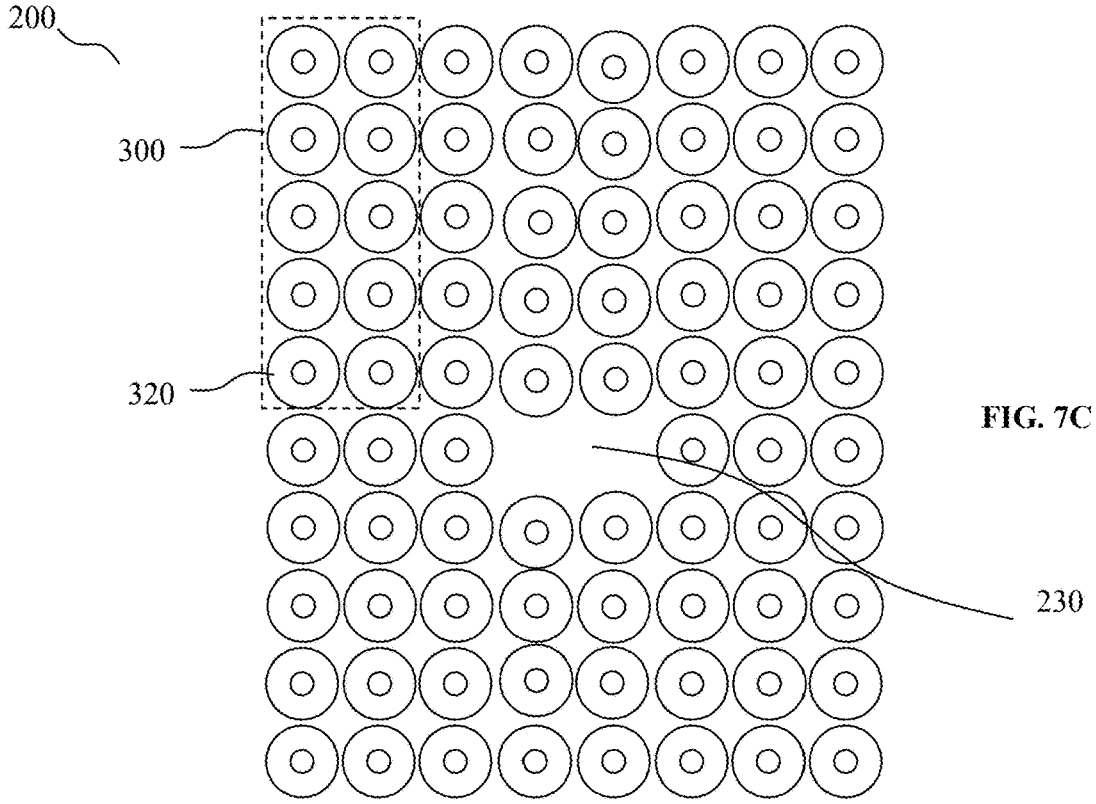
FIG. 7C is a schematic top view of a stack comprising a plurality of package comprising rolled paper products arranged to include an offset zone.
Figure 7D:
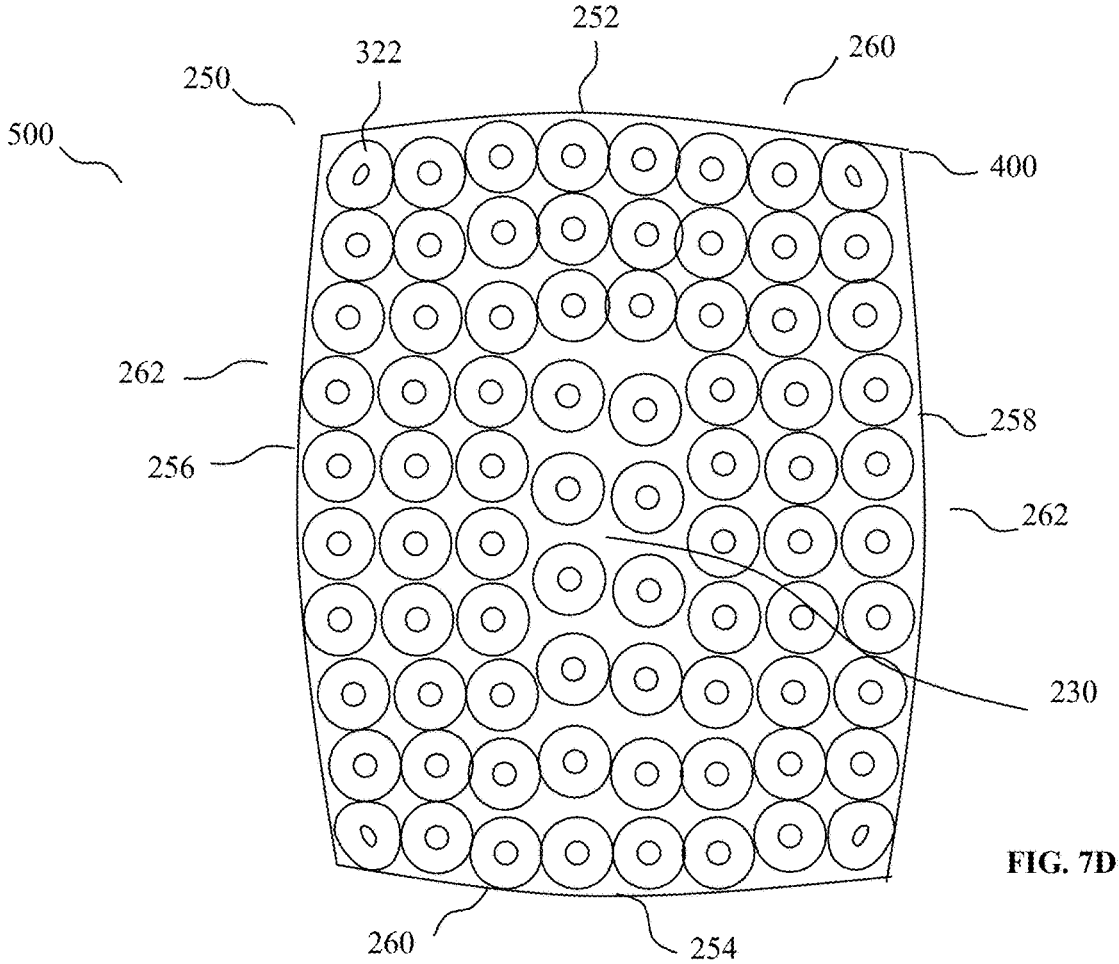
FIG. 7D is a schematic top view of the stack shown in FIG. 7C in a compressed state showing some reversibly compressed rolls and wrapped with an elastically deformable substrate to form a unit load.

Although FIGS. 7A and 7B depict an example where the offset zone 230 is provided adjacent a top and bottom end 252, 254 of the stack 200, in other examples the offset zone 230 may be provided in other regions of the stack 200. For example, FIG. 7C is a schematic top view of a stack 200 comprising a plurality of packages 300 comprising rolled paper products 320 arranged to include an offset zone 230. Unlike the offset zone 230 of FIGS. 7A and 7B that is adjacent to the top and bottom end 252, 254 of the stack 200, the offset zone 230 of FIG. 7C is within an interior of the stack 200. FIG. 7D is a schematic top view of the stack 200 shown in FIG. 7C in a compressed state showing some reversibly compressed rolls 322 and wrapped with an elastically deformable substrate 400 to form a unit load 500.

Figure 7E:
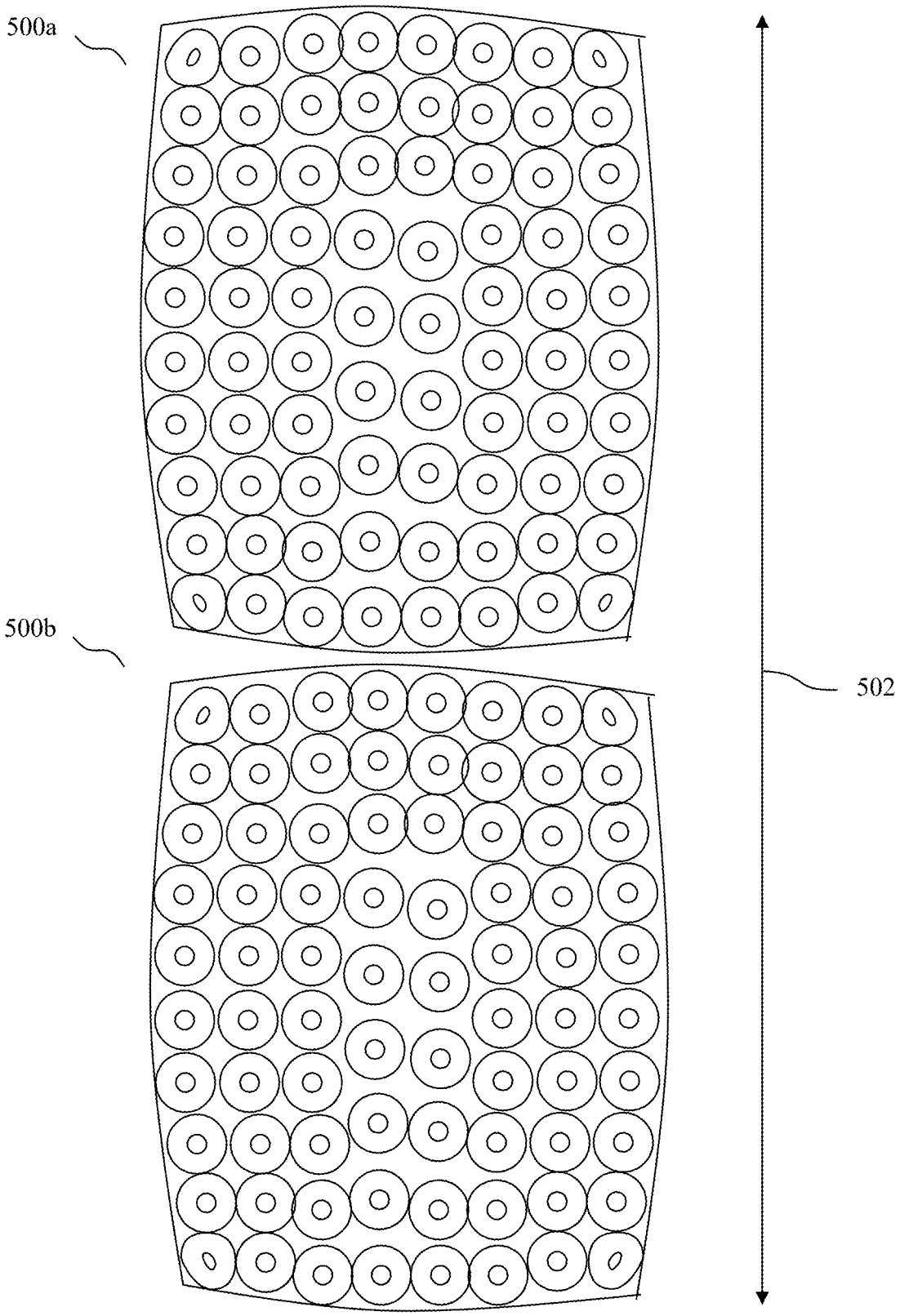
FIG. 7E is a schematic top view of an adjacent pair of the unit loads shown in FIG. 7D prior to being loaded into a vehicle.

As discussed in the method herein, when compressed stacks such as those depicted in FIGS. 7A through 7D are loaded into an area, such as a bed of a vehicle (e.g. truck) for transport, more than one compressed stack may be simultaneously loaded into the area. Thus, in some examples, prior to loading the compressed stacks into the area, they may be grouped and/or aligned. FIG. 7E is a schematic top view of an adjacent pair of the unit loads 500*a*, 500*b* shown in FIG. 7D prior to being loaded into a vehicle. As shown in FIG. 7E, the pair of unit loads 500*a*, 500*b* may be positioned adjacent to each other, such that the top end 252 of a first unit load 500*a* adjoins and/or contacts the bottom end 254 of a second unit load 500*a*. Thus, in this example, the pair of unit loads 500*a*, 500*b* may have a combined unit length 502 that may be based on a sum of the compressed maximum stack length 266 (e.g. measured at the midpoint, or region of maximum stack length) of the pair of unit loads 500*a*, 500*b*. The compressed maximum stack length 266 may be measured based on the Stack Measurement Method disclosed herein.

Figure 8:
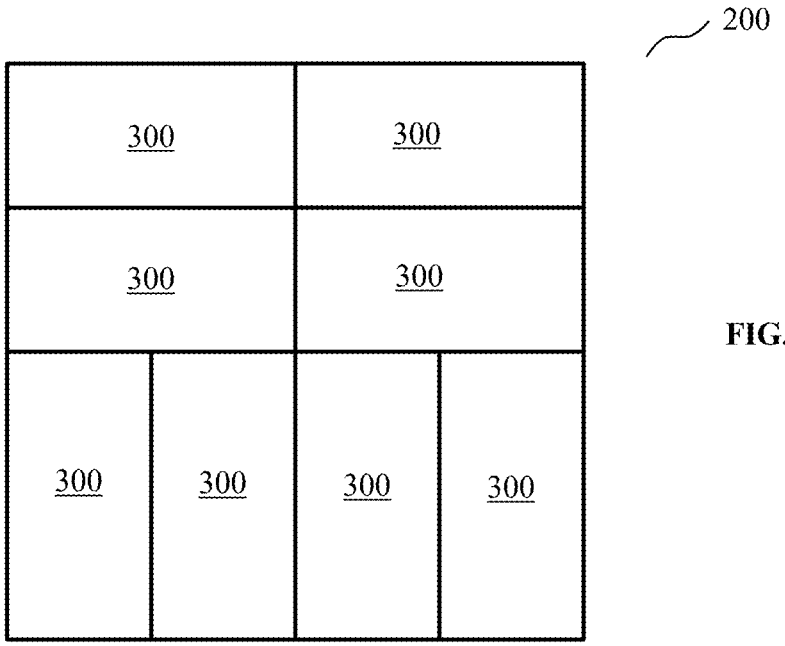
FIG. 8 is a schematic top view of a stack comprising a plurality of packages.
Figure 10:
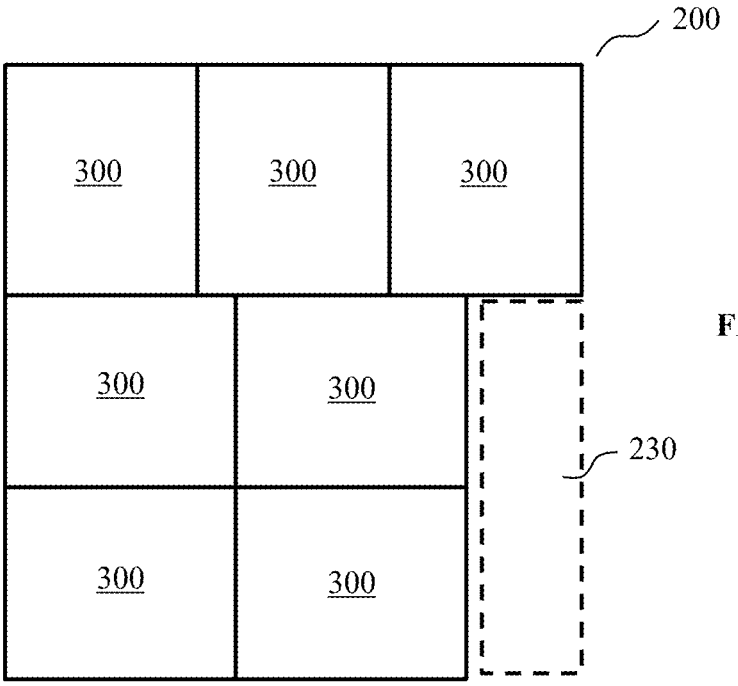
FIG. 10 is a schematic top view of a stack comprising a plurality of package arranged to include an offset zone.
Figure 11:
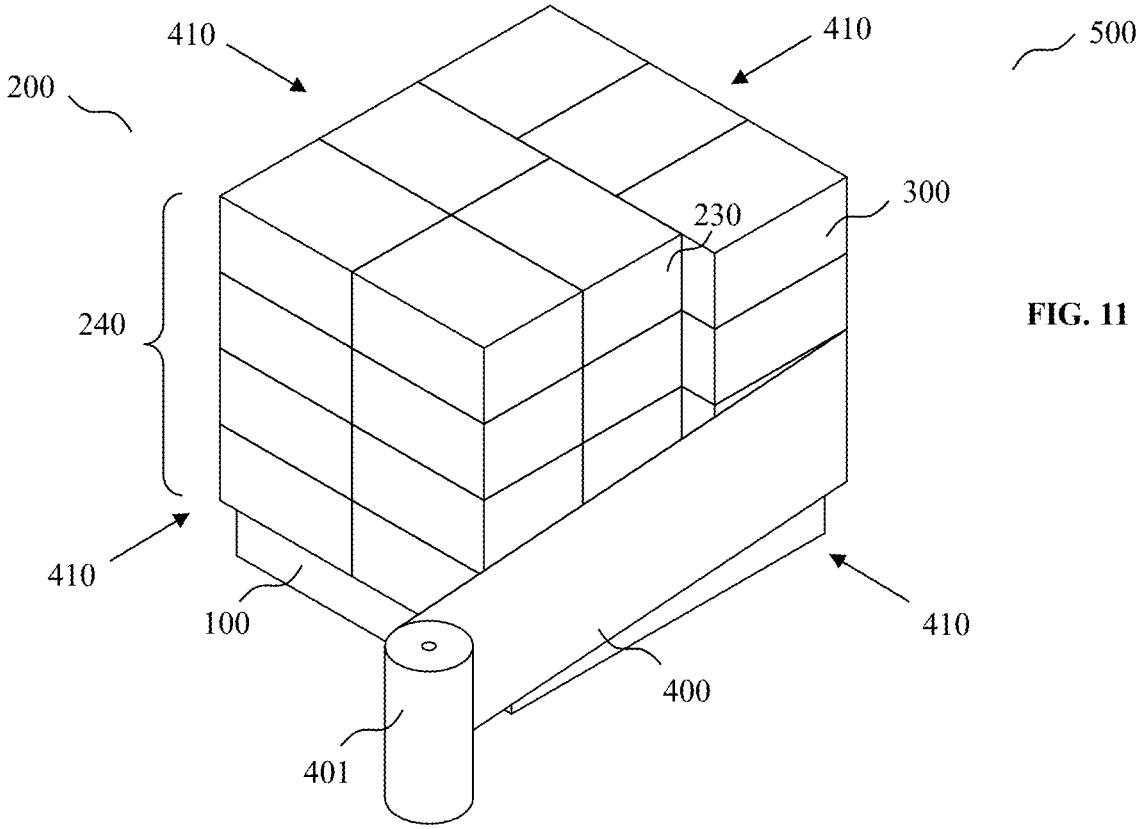
FIG. 11 is a schematic perspective view of a stack on a pallet in the configuration shown in FIG. 10 being wrapped with an elastically deformable substrate to form a unit load.
Figure 12:
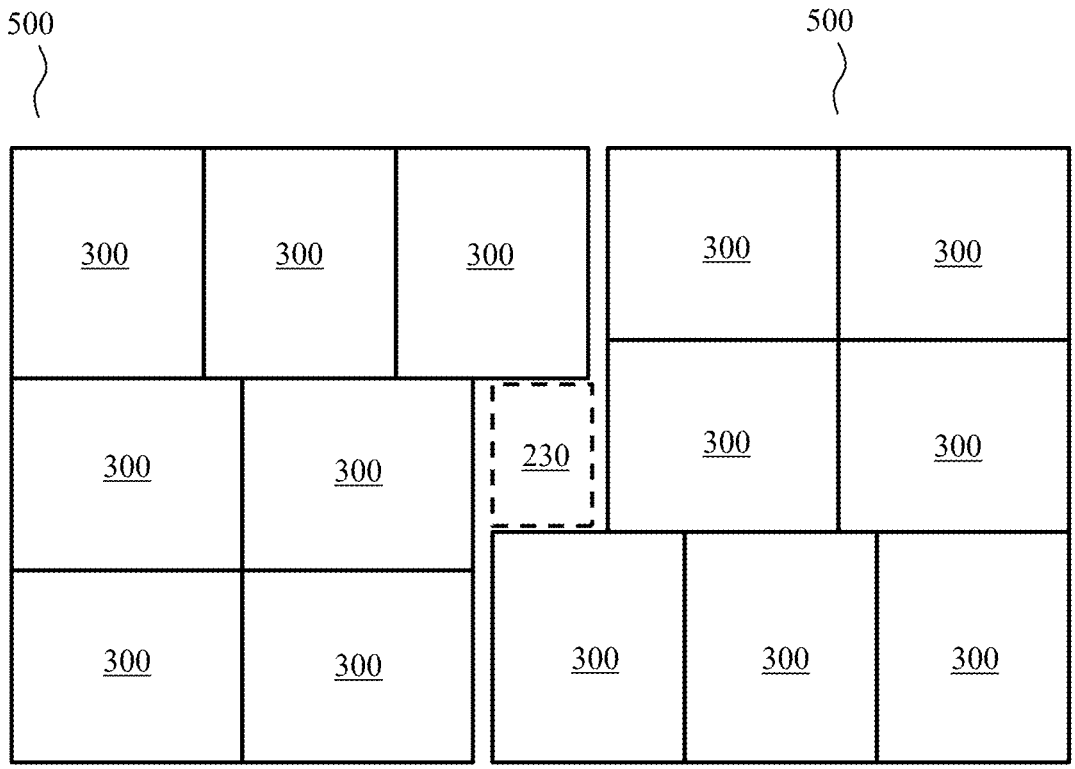
FIG. 12 is a schematic top view of a pair of unit loads as shown in FIG. 11 arranged with overlapping offset zones to occupy less space when arranged side-by-side, for example, in a truck.

Some other configurations of stacks 200 are shown in FIG. 8, FIG. 9, FIG. 10, and FIG. 11. FIG. 8 is a schematic top view of a stack 200 comprising a plurality of packages 300. FIG. 9 is a schematic perspective view of a stack 200 on a pallet 100 in the configuration shown in FIG. 8 being wrapped with an elastically deformable substrate 400 to form a unit load 500. FIG. 10 is a schematic top view of a stack 200 comprising a plurality of package 300 arranged to include an offset zone 230. FIG. 11 is a schematic perspective view of a stack 200 on a pallet 100 in the configuration shown in FIG. 10 being wrapped with an elastically deformable substrate 400 to form a unit load 500. FIG. 12 is a schematic top view of a pair of unit loads 500 as shown in FIG. 11 arranged such that the offset zones 230 overlap, allowing the pair of unit loads 500 to occupy less space when arranged side-by-side, for example, in a truck.

A technique employed to wrap the elastically deformable substrate 400 around the unit load 500 is now discussed, where the wrapped substrate 400 secures the stack 200 to the pallet 100. As discussed herein, various aspects of the wrapping of the substrate 400 may be adjusted and optimized, depending on various characteristics of the unit load 500 (e.g. an extent that the stack 200 overhangs the pallet 100).

Figure 13A:
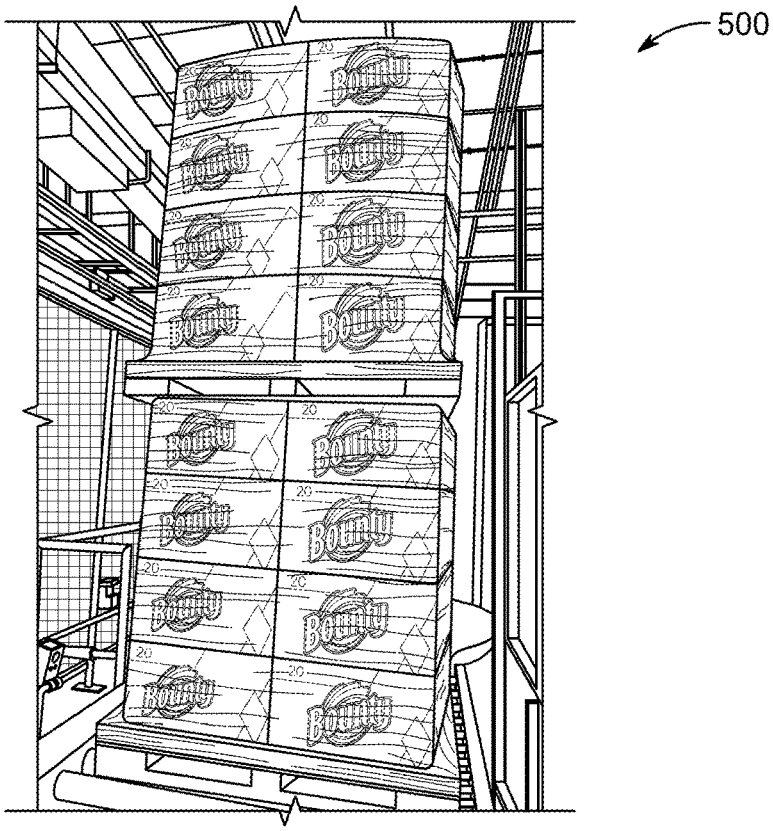
FIGS. 13A and 13B are images that show a side perspective view of the unit load of FIG. 7C including the elastically deformable substrate secured between the stack and pallet.
Figure 13B:
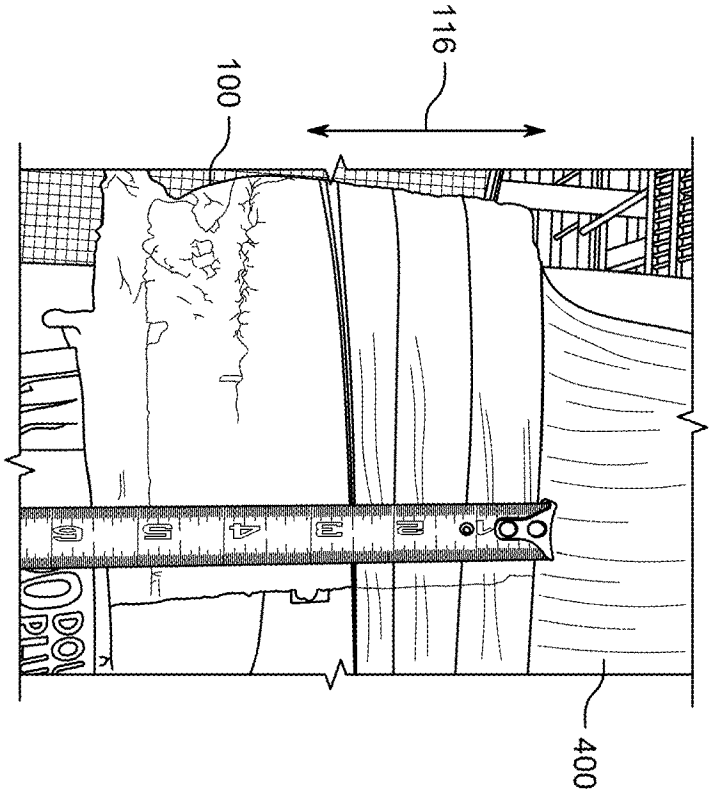

FIGS. 13A and 13B are images that show a side perspective view of the unit load 500 of FIG. 7C including the elastically deformable substrate 400 secured between the stack 200 and pallet 100. As shown in FIG. 13B, the substrate 400 may be wrapped around the pallet 100 and stack 200 such that the substrate 400 is adhered along a minimum portion 116 of a height of the pallet 100. It was found that by ensuring that the substrate 400 is wrapped and adhered along the minimum portion 116 of the height of the pallet 100, this advantageously ensures that the wrapped substrate 400 securely attaches the stack 200 to the pallet 100.

Figure 13C:
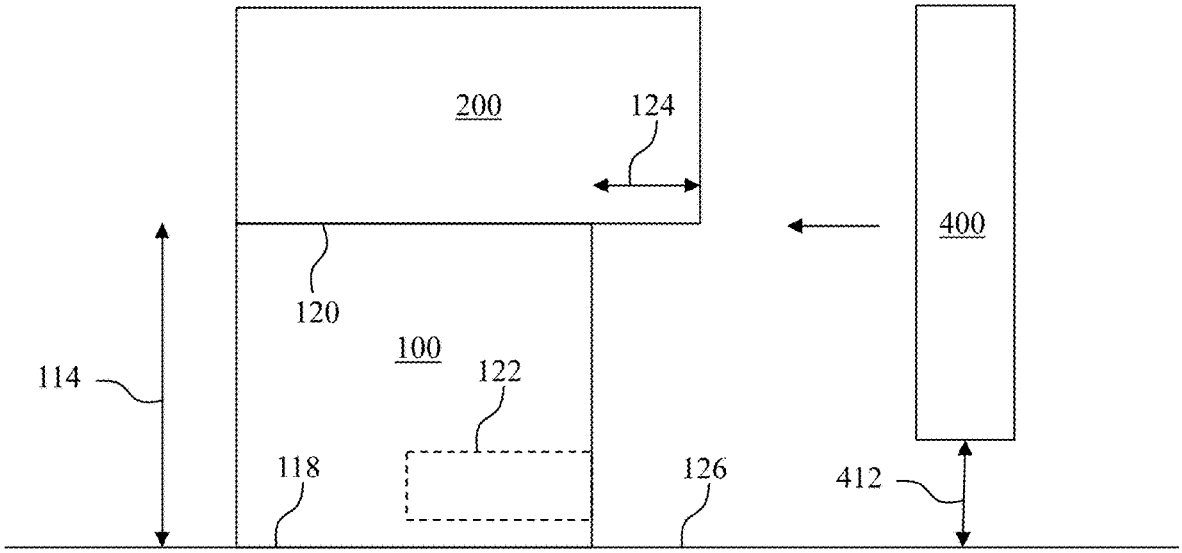
FIGS. 13C and 13D are schematic side views of the elastically deformable substrate of FIG. 13B being wrapped around the stack, the pallet and a first overhang distance therebetween.
Figure 13D:
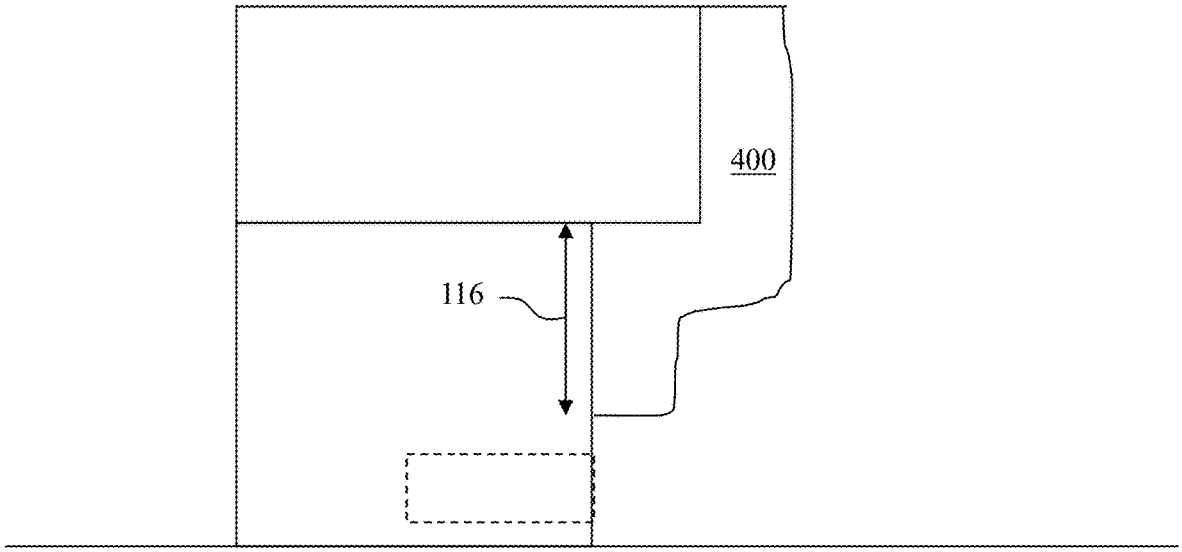

FIGS. 13C and 13D are schematic side views of the elastically deformable substrate 400 of FIG. 13B being wrapped around the stack 200, the pallet 100 and a first overhang distance 124 therebetween. As shown in FIGS. 13C and 13D, the wrapping of the substrate 400 may include wrapping the stack 200 and the pallet 100 with the elastically deformable substrate 400 such that the elastically deformable substrate 400 engages the portion 116 of a height 114 of the pallet 100. As shown in FIG. 13C, the height 114 of the pallet 100 may be defined between a bottom surface 118 and a top surface 120 on which the stack 200 is disposed on the pallet 100. As further shown in FIG. 13D, the portion 116 of the height 114 over which the elastically deformable substrate 400 adheres to the pallet 100 may be measured and thus may extend from the top surface 120 of the pallet 100.

In one example, the portion 116 of the height 114 may be greater than a minimum height threshold (e.g. about 2 inches) to secure the stack 200 to the pallet 100 and may also be less than a maximum height threshold (e.g. about 3 inches) to avoid covering an opening 122 (FIG. 13C) in the pallet 100 configured to receive a fork of a forklift. In one example, the height 114 of the pallet 100 may be in a range from about 5 inches to about 6 inches and the portion 116 of the height 114 may be about 2.5 inches or in a range from about 2 inches to about 3 inches.

In one example, the overhang distance 124 may be based on the compressed maximum stack length 266 being greater than the pallet length 111 and/or the compressed maximum stack width 272 being greater than the pallet width 112 by the overhang distance 124. In this example, as shown in FIG. 13C, the wrapping of the elastically deformable substrate 400 may involve positioning the elastically deformable substrate 400 at a height 412 from a floor surface 126 on which the pallet 100 is disposed. As discussed below, the value of the height 412 may be based on the value of the overhang distance 124, so to ensure that the substrate 400 covers the portion 116 of the pallet height 114. In one example, the value of the height 412 may be about 2 inches or in a range from about 1 inch to about 3 inches and the value the overhang distance 124 may be about 2.75 inches or in a range from about 2 inches to about 3 inches.

Figure 13E:
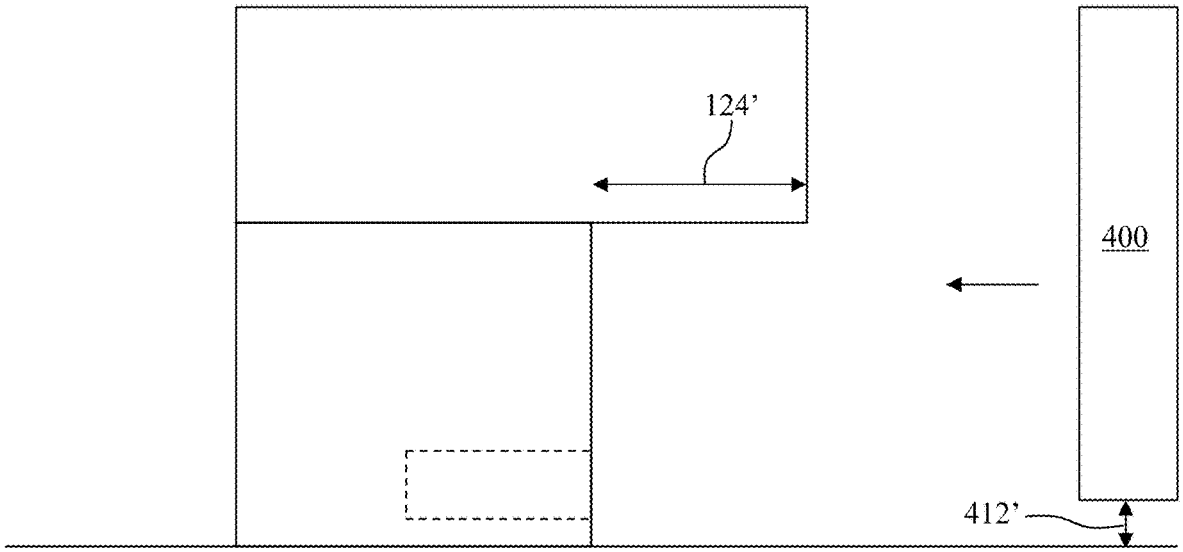
FIGS. 13E and 13F are schematic side views of the elastically deformable substrate of FIG. 13B being wrapped around the stack, the pallet and a second overhang distance therebetween.
Figure 13F:
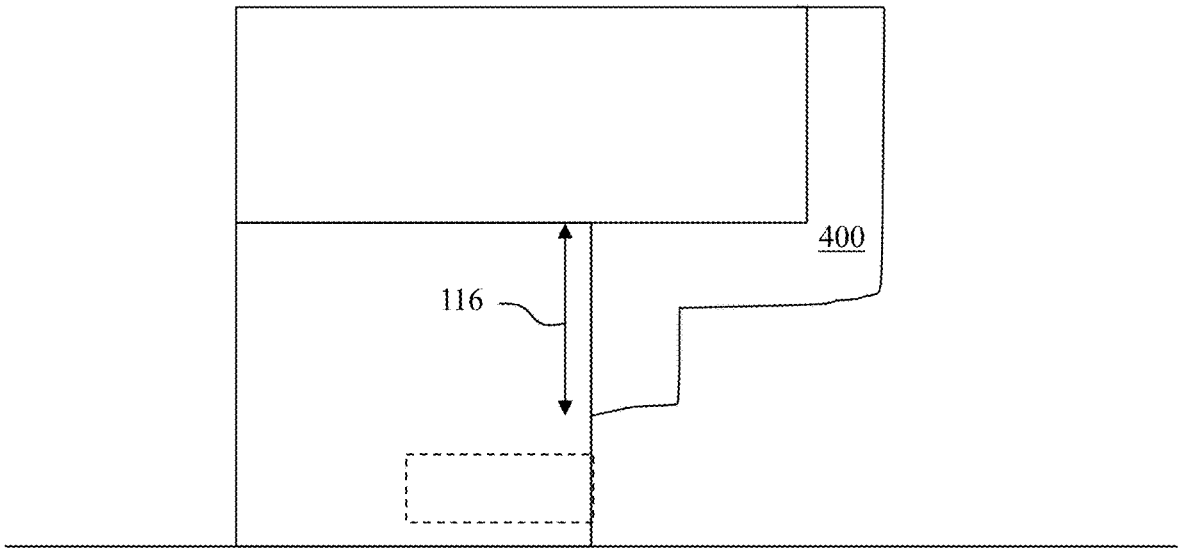

In one example the value of the height 412 may be inversely proportional to the value of the overhang distance 124. In one example, a greater overhang distance 124 may necessitate a lower height 412 in order for the wrapped substrate 400 to adhere over the minimum portion 116 of the height 114 of the pallet 100. This is now discussed with respect to FIGS. 13E and 13F. FIGS. 13E and 13F are schematic side views of the elastically deformable substrate 400 of FIG. 13B being wrapped around the stack 200, the pallet 100 and a second overhang distance 124' therebetween. In one example, the second overhang distance 124' of FIG. 13E is greater than the overhang distance 124 of FIG. 13C. Thus, in one example, since the second overhang distance 124' is greater, the elastically deformable substrate 400 may be positioned at a lower height 412' (FIG. 13E) from the floor surface 126 than the substrate 400 in FIG. 13C. This may be due to a greater amount of the elastically deformable substrate 400 being needed to cover the larger overhang distance 124' (e.g. in a horizontal dimension, viewing FIGS. 13E and 13F) and thus less of the elastically deformable substrate 400 being available to cover the minimum portion 116 of the height of the pallet 100. Consequently, as shown in FIG. 13E, the elastically deformable substrate 400 may be positioned at a lower height 412' from the floor surface 126 which effectively means a greater amount of substrate 400 is available to wrap around the interface between the stack 200 and the pallet 100, including along the overhang distance 124' and the minimum portion 116 of the pallet height. In one example, the value of the height 412' may be about 1 inch or in a range from about 0 inches to about 2 inches and the value of the second overhang distance 124' may be about 3 inches or in a range from about 2.5 inches to about 3.5 inches.

Although FIGS. 13C through 13E depict that the elastically deformable substrate 400 may be positioned at a certain height 412 above the floor surface 126, this is merely one example of how the substrate 400 may be positioned in order to wrap around the stack 200 and pallet 100. In other examples, where the stack 200 and pallet 100 are mounted on a raised surface above the floor surface 126, the substrate 400 may be positioned below the raised surface (on which the pallet 100 is mounted) and may still wrap around the stack 200 and the pallet 100. This may be advantageous, in the event that the overhang distance 124 is so large that the substrate 400 needs to be positioned below the surface on which the pallet 100 is mounted (e.g. raised surface in this example) when wrapping around the stack 200 and pallet 100.

Method for Loading a Plurality of Unit Loads Into a Vehicle

A method is now discussed herein, for loading one or more pairs of unit loads into an area, such as a bed of a vehicle (e.g. moving truck) to transport the one or more pairs of unit loads. FIGS. 14A through 14H are schematic top views showing one or more steps of a method for loading a plurality of the unit loads 500*a*, 500*b* of FIG. 7D into a bed 604 of a vehicle 600.

Figure 14A:
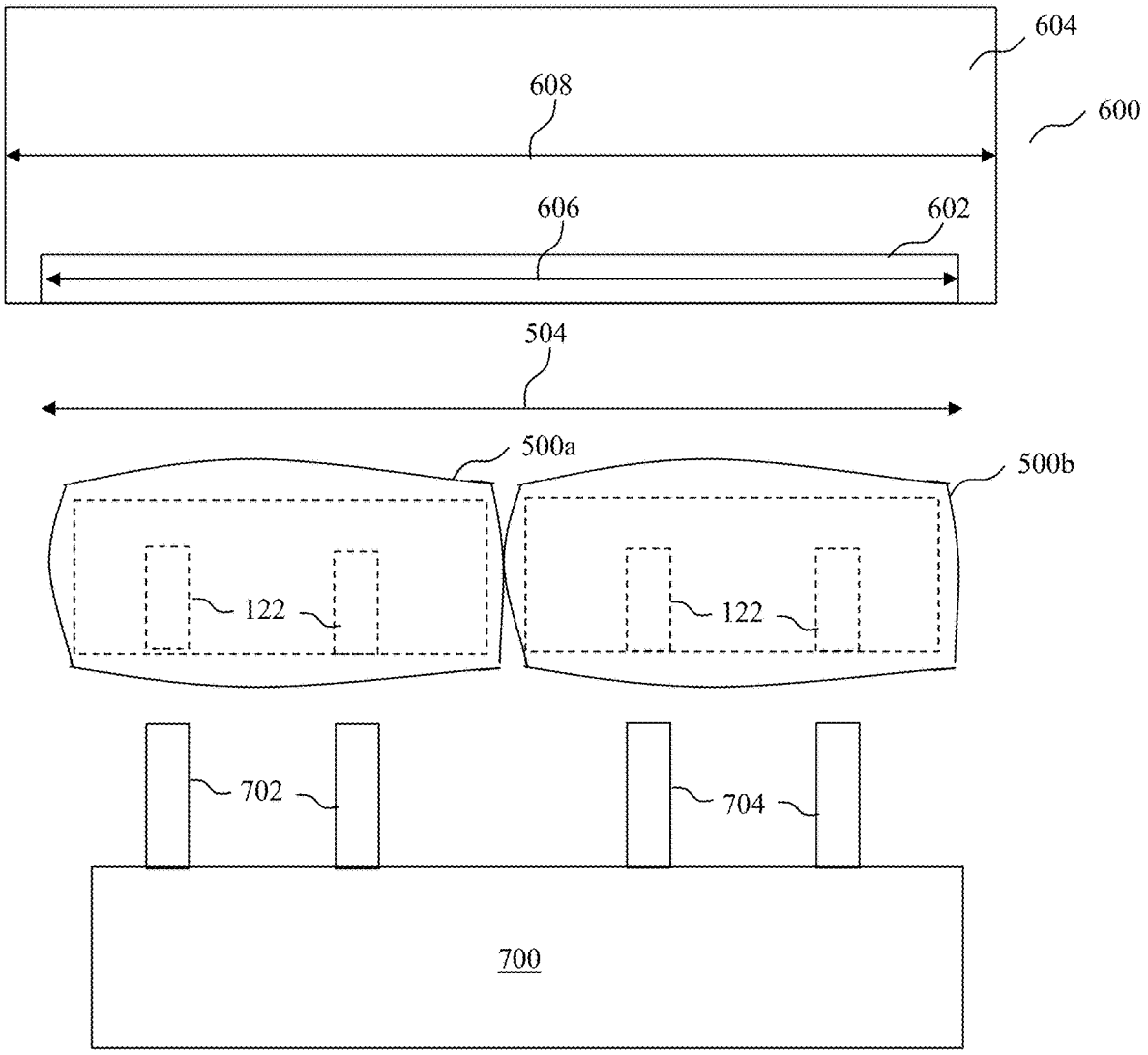
FIGS. 14A through 14H are schematic top views showing one or more steps of a method for loading a plurality of the unit loads of FIG. 7D into a bed of a vehicle.

As shown in FIG. 14A, one or more pairs of unit loads 500*a*, 500*b* may be provided. Although only one pair of unit loads 500*a*, 500*b* is depicted in FIG. 14A, the method disclosed herein may load multiple pairs of unit loads 500*a*, 500*b* into the bed 604 of the vehicle 600.

Figure 14B:
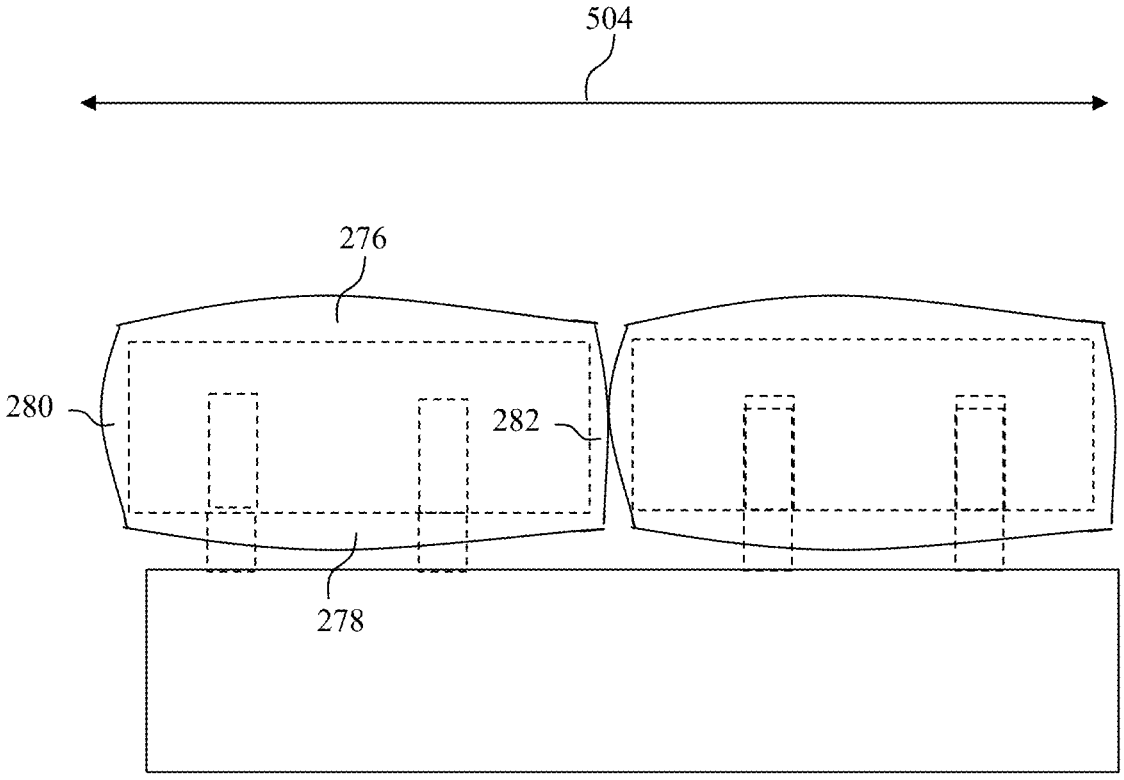

As further shown in FIG. 14A, a first pair of forks 702 of a forklift machine 700 may be inserted into a pair of openings 122 defined by a pallet 100 of the first unit load 500*a*. FIG. 14B depicts the first pair of forks 702 of the forklift machine 700 inserted within the openings 122 defined by the first unit load 500*a*.

Similarly, as shown in FIG. 14A, a second pair of forks 704 of a forklift machine 700 may be inserted into a pair of openings 122 defined by a pallet 100 of the second unit load 500*b*. FIG. 14B depicts the first pair of forks 702 of the forklift machine 700 inserted within the openings 122 defined by the second unit load 500*b*. In some embodiments, an additional pair of unit loads may be positioned on top of the pair of unit loads 500*a*, 500*b* such that the forklift machine 700 may be capable of simultaneously moving four pairs of unit loads 500*a*, 500*b*. However, for purposes of simplicity, the method herein will be discussed in which the forklift machine 700 may move a single pair of unit loads 500*a*, 500*b* at a time.

As shown in FIG. 14B, in one example each unit load 500*a*, 500*b* may feature a right overhang 276 which the right side 258 of the stack 200 overhangs the pallet 100, a left overhang 276 which the left side 256 of the stack 200 overhangs the pallet 100, a top overhang 280 that the top end 252 overhangs the pallet 100 and a bottom overhang 282 which the bottom end 254 overhangs the pallet 100. Additionally, as shown in FIG. 14B upon the forks 702, 704 of the forklift machine 700 being inserted within the openings 122 defined by the first and second unit load 500*a*, 500*b*, the unit load pair 500*a*, 500*b* may have a combined unit load pair length with a first value 504. In one example, the first value 504 is about 101 inches or in a range from about 100 inches to about 102 inches.

Figure 14C:
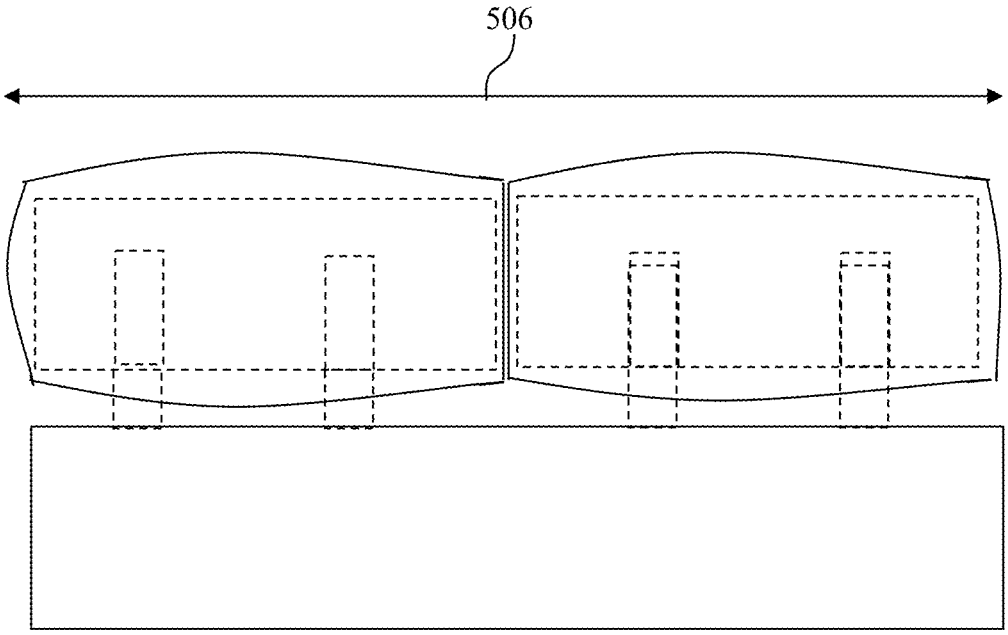

As shown in FIGS. 14B and 14C, for each of the pairs of unit loads 500*a*, 500*b*, the first pair of forks 702 and the second pair of forks 704 may be moved together to reduce the bottom overhang 282 in the first unit load 500*a* and to reduce the top overhang 280 in the second unit load 500*b*. By comparing FIGS. 14B and 14C, this moving together of the forks 702, 704 may reduce the combined unit pair length from the first value 504 (FIG. 14B) to a second reduced value 506 (FIG. 14C). In one example the combined unit pair length is defined as a sum of the compressed maximum stack length of each of the unit pairs 500*a*, 500*b*, where the compressed maximum stack length may be measured using the Stack Measurement Method. In one example, the second value 506 is about 99 inches or in a range from about 98 inches to about 100 inches.

Figure 14D:
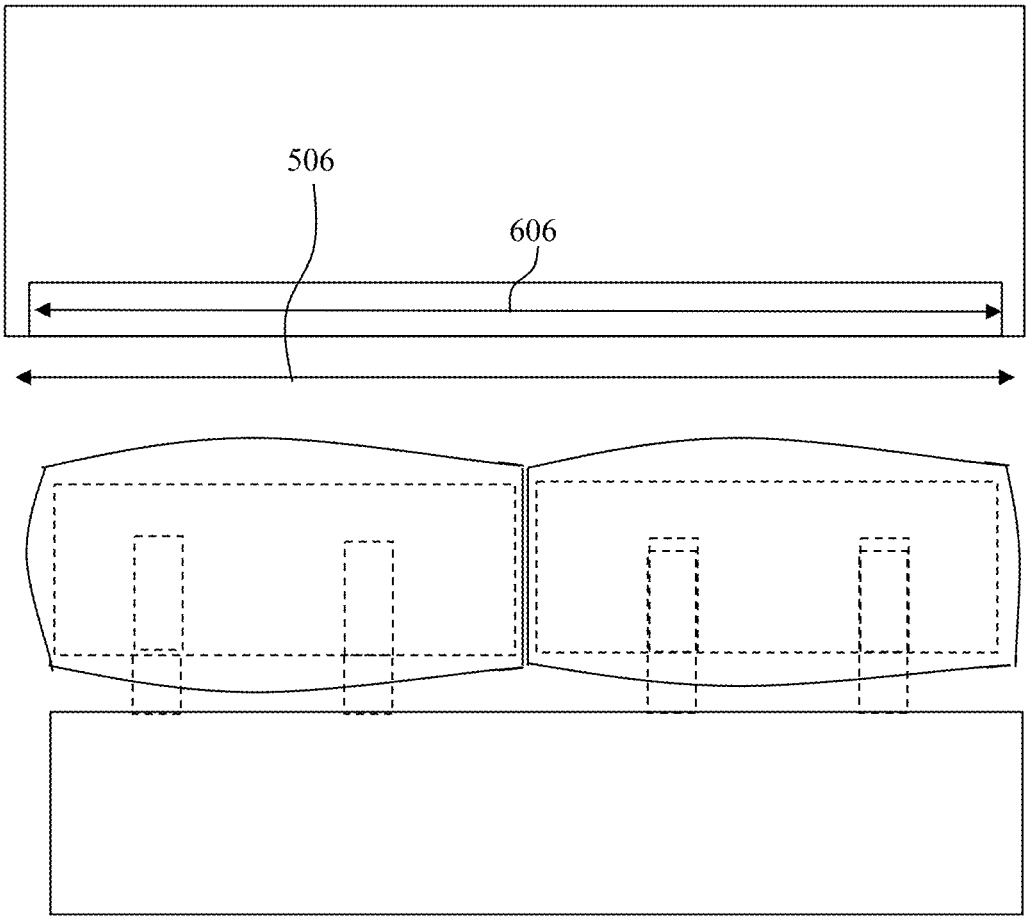
Figure 14E:
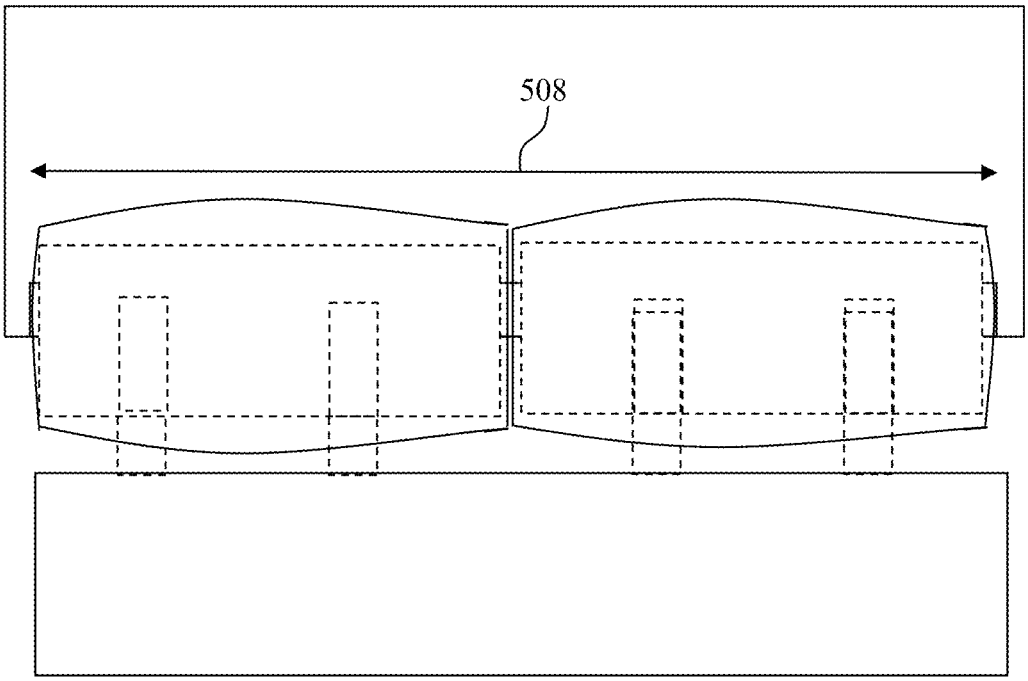

As further shown in FIGS. 14D and 14E, for each of the pairs of unit loads 500*a*, 500*b*, the forklift machine 700 may move the first pair of forks 702 and the second pair of forks 704 to move the first unit load 500*a* and the second unit load 500*b* through an opening 602 (FIG. 14A) defined by the vehicle 600. An inner dimension 606 (e.g. about 98 inches) of the opening 602 may be less than the second value 506 of the combined unit pair length. Although in some examples, the inner dimension 606 may be about 98 inches, in other examples it may vary between about 98 inches and about 101 inches. Thus, since the inner dimension 606 of the opening 602 is less than the second value 506 of the combined unit pair length, conventionally it was not expected that the pair of unit loads 500*a*, 500*b* could fit through the opening 602 of the vehicle 600. Consequently, as disclosed herein, it was a surprising result that the method steps herein nevertheless did fit the pair of unit loads 500*a*, 500*b* through the opening 602 and into the bed 604 of the vehicle 600.

As shown in FIG. 14E, the forklift machine 700 is shown moving the pair of unit loads 500*a*, 500*b* through the opening 602. For each of the pairs of unit load 500*a*, 500*b*, as the forklift machine 700 moves the pair of unit loads 500*a*, 500*b* through the opening 602, surfaces of the vehicle 600 that form the opening 602 may inwardly compress the stack 200 of the first unit load 500*a* and the second unit load 500*b* based on the offset zone 230 created within the stack 200. As a consequence, as depicted in FIGS. 14D and 14E, the combined unit pair length is further reduced from the second value 506 (FIG. 14D) to a third value 508 (FIG. 14E). The third value 508 of the combined unit pair length may be equal to or less than the inner dimension 606 of the opening 602 (e.g. about 98 inches). This is another surprising result, since the offset zone 230 within each stack 200 was conventionally understood as an indication of suboptimal spatial efficiency, since some volume of the stack 200 is not encompassed by packages 300. However, as disclosed herein, the offset zone 230 advantageously facilitated the inward compression of the stacks 200 in each of the pair of unit loads 500*a*, 500*b* so to ensure that the pair of unit loads 500*a*, 500*b* fit through the opening 602 which the pair of unit loads may not have otherwise fit through, in the absence of the offset zone 230.

It should be emphasized that no particular configuration of the offset zone 230 disclosed herein is required in order for the pair of unit loads 500*a*, 500*b* to fit through the vehicle opening 602. Thus, in yet other examples, no offset zone 230 may be provided and yet the pair of unit loads 500*a*, 500*b* may still be capable of the inward compression to fit through the vehicle opening 602, due to the inward compressibility of the roller paper products 320.

Figure 14F:
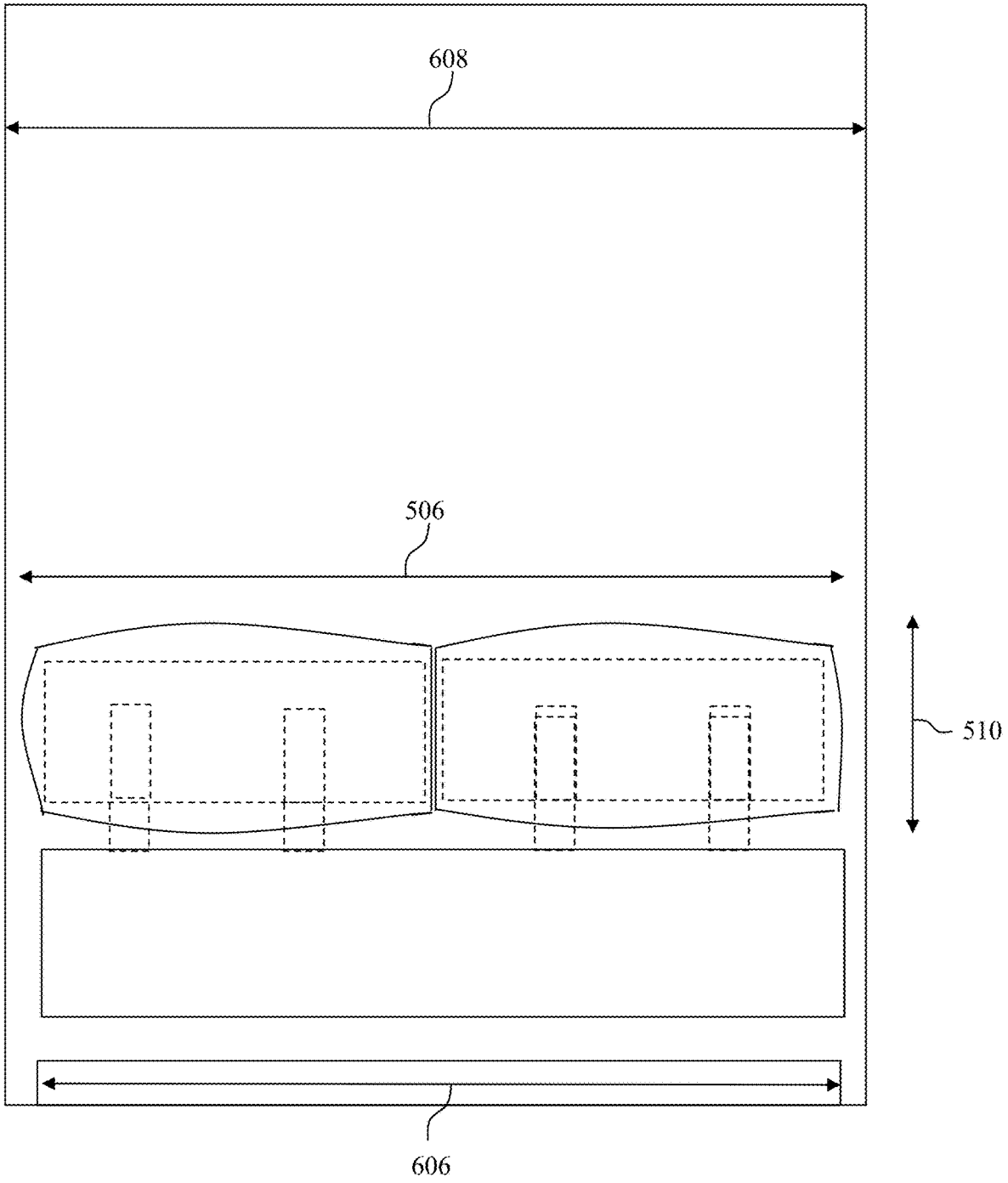

As shown in FIG. 14F, for the pairs of unit loads 500*a*, 500*b*, upon moving the stack 200 of the first unit load 500*a* and the second unit load 500*a* through the opening 602 and into the bed 604 of the vehicle 600, the stack 200 of each unit load 500*a*, 500*b* may outwardly expand such that the combined unit pair length increases from the third value 508 (FIG. 14E) back to the second value 506 (FIG. 14F). This outward expansion may be due to the bed 604 of the vehicle 600 having a larger interior dimension 608 (FIG. 14F) than the inner dimension 606 of the opening 602, as well as the second and third value 506, 508 of the combined unit pair length. In one example, the interior dimension 608 of the truck bed 604 may be about 101 inches. However, in other examples, the interior dimension 608 may vary between about 98 inches and about 101 inches.

Figure 14G:
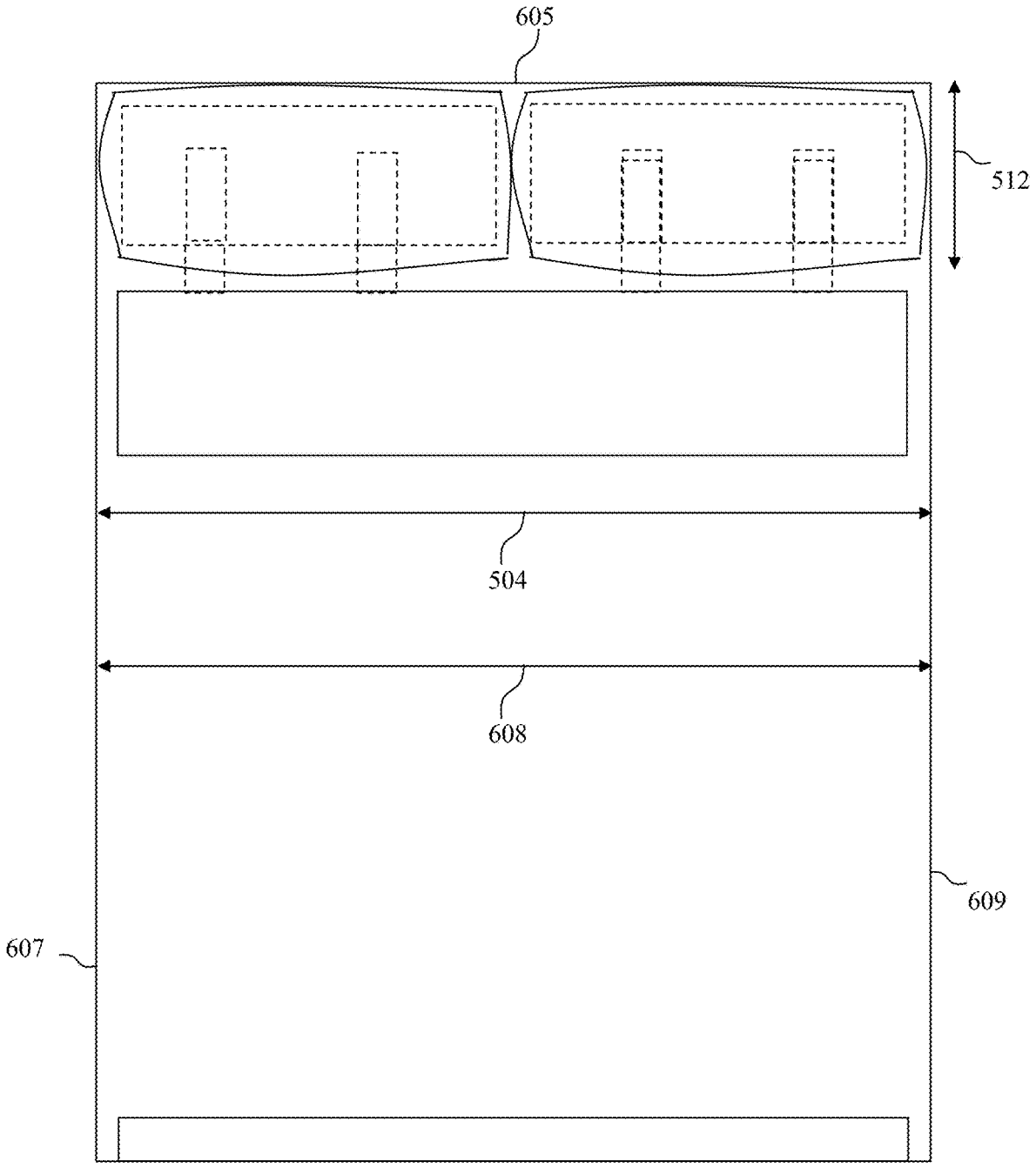

As further shown in FIG. 14G, once the pair of unit loads 500*a*, 500*b* are moved into the bed 604 of the vehicle 600, the first pair of forks 702 and the second pair of forks 704 of the forklift machine 700 may be moved apart to increase the bottom overhang 282 in the first unit load 500*a* and increase the top overhang 280 in the second unit load 500*b* such that the combined unit pair length increases from the second value 506 (FIG. 14F) back to the first value 504 (FIG. 14G). As shown in FIGS. 14F and 14G, the interior width dimension 608 of the truck bed 604 between a left sidewall 607 and a right sidewall 609 may be about equal to the first value 504 of the combined unit pair length, such that the pair of unit loads 500*a*, 500*b* fit within the truck bed 604. Also, as shown in FIG. 14G, where the interior width dimension 608 of the truck bed 604 may be equal to the first value 504 of the combined unit pair length, the outer surfaces of the pair of unit loads 500*a*, 500*b* may contact the sidewalls 607, 609 of the truck bed 604. In one example, the arc 260 along the bottom end 254 of a first unit load 500*a* may contact the left sidewall 607 on a first side of the truck bed 604 whereas the arc 260 along the top end 252 of a second unit load 500*b* may contact the right sidewall 609 along a second side of the truck bed 604.

As further shown in FIG. 14G, for the pair of unit loads 500*a*, 500*b*, the first pair of forks 702 and second pair of forks 704 of the forklift machine 700 may be moved so to move the stacks 200 of the unit loads 500*a*, 500*b* against a rear wall 605 of the truck bed 604. This may result in inward compression of the stacks 200 of the unit loads 500*a*, 500*b* based on the offset zone 230 to reduce the right overhang 276 so that a maximum stack width of the first and second unit loads 500*a*, 500*b* is reduced from a first value 510 (FIG. 14F) to a second value 512 (FIG. 14G), where the maximum stack width is measured using the Stack Measurement Method disclosed herein. In one example, the first value 510 is in a range from about 43 inches to about 45 inches and the second value 512 is in a range from about 42 inches to about 44 inches.

Figure 14H:
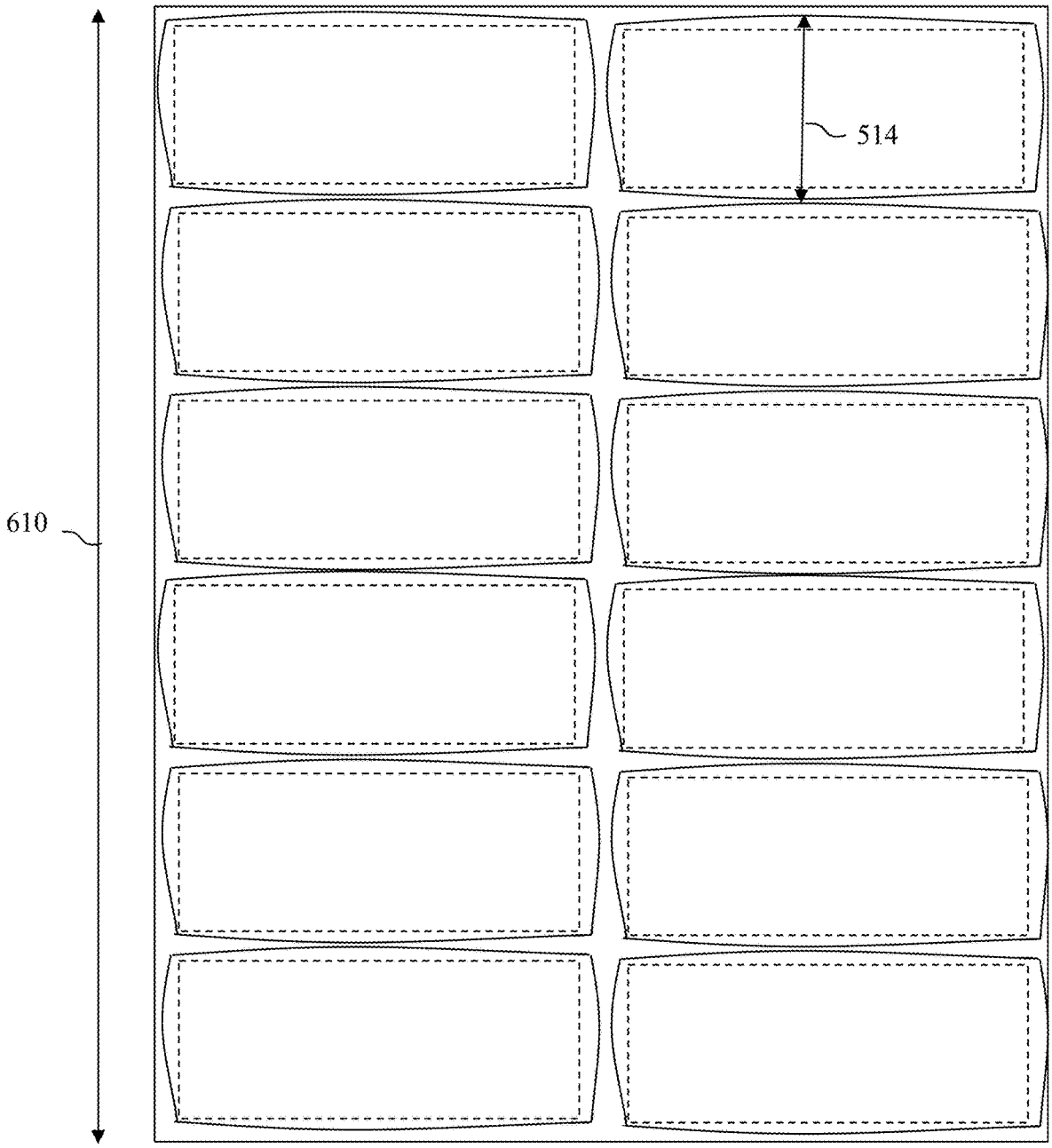

As further shown in FIG. 14H, as each unit load pair 500*a*, 500*b* is moved into the bed 604 of the vehicle 600, subsequent pairs of unit loads 500*a*, 500*b* may inwardly compress a precedent pair of unit loads 500*a*, 500*b* along the width dimension. For example, as shown in FIG. 14H, by loading a subsequent pair of unit loads 500*a*, 500*b* into the bed 604 of the vehicle 600 (e.g. second pair of unit loads from the top of FIG. 14H), this subsequent pair of unit loads 500*a*, 500*b* may be moved against the precent pair of unit loads 500*a*, 500*b*. This may cause the left overhang 278 (previously uncompressed, as shown in FIG. 14G) to be inwardly compressed so to reduce the maximum stack width of the unit load pair 500*a*, 500*b* from the second value 512 (FIG. 14G) to a third value 514 (FIG. 14H). In one example, the third value 514 is in a range from about 41.5 inches to about 42.4 inches.

Prior to developing the method herein, conventional approaches deemed it not possible to fit a certain quantity (e.g. 15) of the pair of unit loads 500*a*, 500*b* within the vehicle bed 604, since the sum of the first value 510 (FIG. 14F) of the maximum stack width for the quantity of pairs of unit loads 500*a*, 500*b* exceeded the an interior length dimension 610 (FIG. 14H) of the vehicle bed 604. In one example, the interior length dimension 610 may be about 53 feet. However, in light of the method disclosed herein, it was found that this certain quantity (e.g. 15) of the pair of unit loads 500*a*, 500*b* can be fit within the vehicle bed 604 using the method disclosed herein, which reduces the maximum stack width of each unit load 500*a*, 500*b* from the first value 510 to the second value 512 and even further to the third value 514. In this example, a sum of the third value 514 of the maximum stack width for the quantity (e.g. 15) of the unit load pairs 500*a*, 500*b* does not exceed the interior length dimension 610 of the vehicle bed 604.

Figure 15:
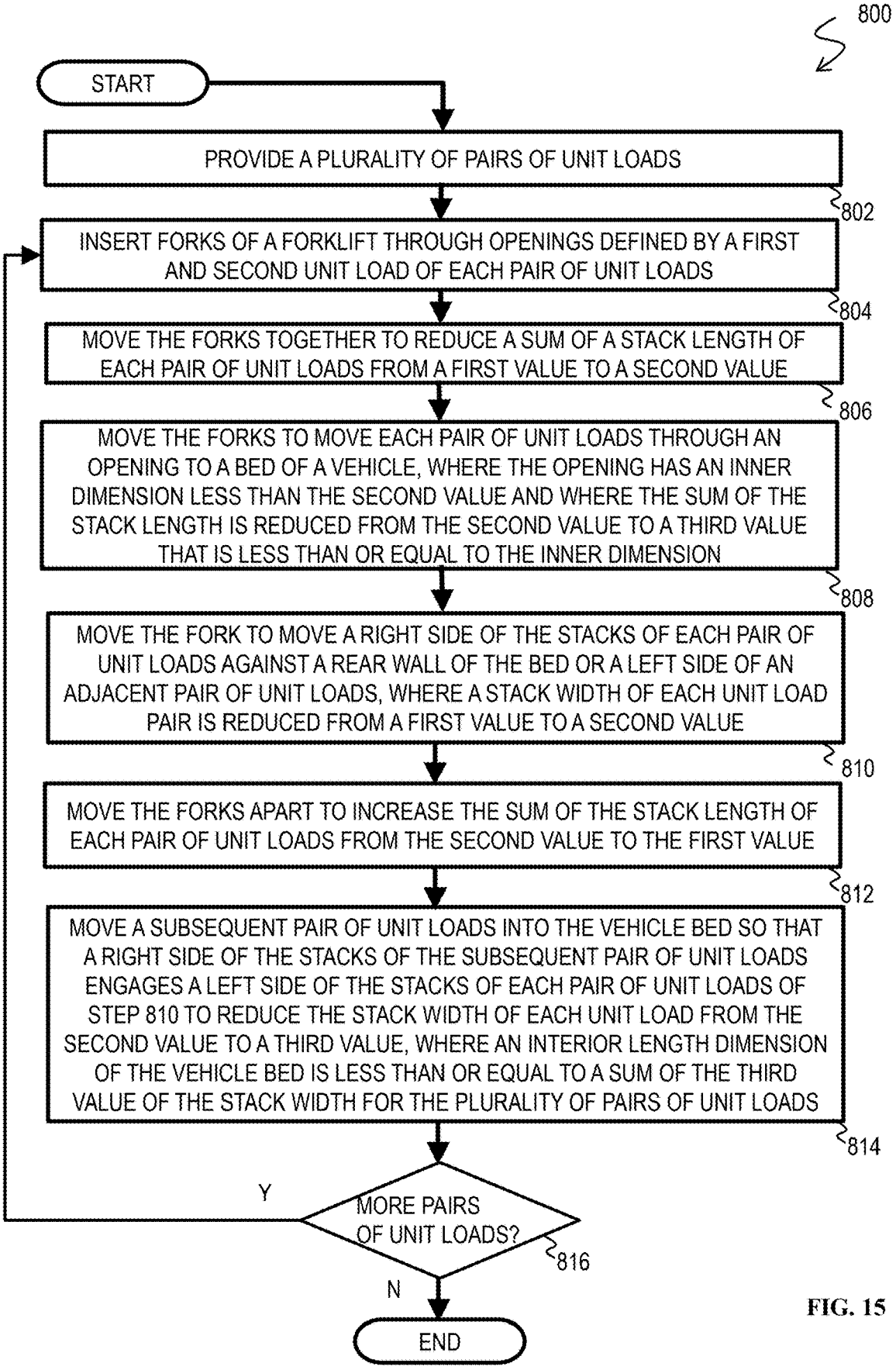
FIG. 15 is a flowchart that depicts one or more steps of a method for loading a plurality of unit loads of FIG. 7D into a bed of a vehicle.

FIG. 15 is a flowchart that depicts one or more steps of a method 800 for loading a plurality of pairs of unit loads 500*a*, 500*b* of FIG. 7D into a bed of a vehicle.

In step 802, the plurality of pairs of unit loads 500*a*, 500*b* may be provided. In some examples, a quantity (e.g. 15) of the pairs of unit loads 500*a*, 500*b* are provided.

In step 804, the forks 702, 704 of the forklift machine 700 may be inserted within the openings 122 defined by the first and second unit load 500*a*, 500*b* (FIGS. 14A and 14B).

In step 806, the forks 702, 704 may be moved together to reduce the combined unit length of the pair of unit loads 500*a* from the first value 504 (FIG. 14B) to the second value 506 (FIG. 14C). It should be noted that in some examples, a gap between the pair of unit loads 500*a*, 500*b* may also be reduced in step 806.

In step 808, the forks 702, 704 of the forklift machine 700 may move the pair of unit loads 500*a*, 500*b* through the opening 602 defined by the vehicle 600 and into the vehicle bed 604. In one example, in step 808 the interior surfaces of the vehicle 600 defining the opening 602 may inwardly compress the stacks 200 of the pair of unit loads 500*a*, 500*b* so to further reduce the combined unit length from the second value 506 (FIG. 14D) to the third value 508 (FIG. 14E). In one example, the third value 508 of the combined unit length may be equal to or less than the inner dimension of the opening 606.

In step 810, the forks 702, 704 of the forklift machine 700 may move the pair of unit loads 500*a*, 500*b* against the rear wall 605 of the vehicle bed 604 which may inwardly compress the stacks 200 of the pair of unit loads 500*a*, 500*b* resulting in a reduction in the maximum stack width from the first value 510 (FIG. 14F) to the second value 512 (FIG. 14G). When step 810 is iterated for subsequent pairs of unit loads 500*a*, 500*b*, the forklift 700 may move the pair of unit loads 500*a*, 500*b* against a left side 256 of the stacks of the previously loaded pair of unit loads 500*a*, 500*b*. In this example, the left side 256 of the stacks of the previously loaded pair of unit loads 500*a*, 500*b* may inwardly compress the stacks of the pair of unit loads 500*a*, 500*b* resulting in the reduction of the maximum stack width from the first value 510 to the second value 512.

In step 812, the forks 702, 704 of the forklift machine 700 may be moved apart which may result in the combined unit length of the pair of unit loads 500*a*, 500*b* to increase from the second value 506 back to the first value 504 (FIGS. 14F and 14G).

In step 814, a subsequent pair of unit loads 500*a*, 500*b* may be moved into the vehicle bed 604, such as by repeating steps 804 through 812. In this example, a right side 258 of the stacks of the subsequent pair of unit loads 500*a*, 500*b* may engage the left side 256 of the stacks of the pair of unit loads 500*a*, 500*b* to reduce the maximum stack width of the pair of unit loads from the second value 512 (in step 810) to the third value 514 (FIG. 14H).

In one example, the method 800 then moves to block 816 where it is determined whether additional pairs of unit loads 500*a*, 500*b* need to be loaded into the vehicle bed 604. If the answer to this inquiry is in the affirmative, the method 800 proceeds back to step 804. If the result of this inquiry is in the negative, then the method 800 ends.

As previously discussed, one notable advantage of the disclosed method here is that the pair of unit loads 500*a*, 500*b*, which have an initial length 504 (FIG. 14A) that exceeds the inner dimension of the opening 606, can nevertheless fit through the opening 602. This was a surprising result, since it was not expected that the pair of unit loads 500*a*, 500*b* would fit through the opening 602. Secondly, another advantage of the disclosed method herein is that a certain quantity (e.g. 15) of the pair of unit loads 500*a*, 500*b* were able to be fit along the interior length dimension 610 of the vehicle bed 604, despite that the sum of the maximum initial width 510 of each of the quantity of unit load pairs exceed the interior length dimension 610.

Table 1 below depicts some example values of various parameters of the stack that were measured using one or more of the Measurement Methods disclosed herein. It should be noted that the example values in Table 1 are merely one sample range of the values of each parameter.

Thus, in other examples, the values and ranges of each parameter may differ from the sample values provided in Table 1.

TABLE 1

| Name | Units | Range | Example 1 | Example 2 | Example 3 |
|---|---|---|---|---|---|
| Uncompressed Maximum Length | inches | | 53.0 | 49.6 | 44.8 |
| Uncompressed Maximum Width | inches | | 41.2 | 44.1 | 44.5 |
| Uncompressed Perimeter | inches | | 188.4 | 187.4 | 178.6 |
| Compressed Maximum Length | inches | 43-51" | 50.0 | 50.1 | 45.8 |
| Compressed Maximum Width | inches | 38-46" | 39.1 | 45.3 | 44.3 |
| Compressed Minimum Length | inches | 40-50" | 48.0 | | |

TABLE 1-continued

| Name | Units | Range | Example 1 | Example 2 | Example 3 |
|---|---|---|---|---|---|
| Compressed Minimum Width | inches | 34-44" | 34.6 | | |
| % Compression | % | | 15% | 13% | 13% |
| Perimeter Top | inches | 150-170" | 159.9 | 164.1 | 156.2 |
| Perimeter Middle | inches | 150-170" | 159.4 | 162.7 | 154.0 |
| Perimeter Bottom | inches | 150-170" | 161.1 | 164.6 | 157.7 |
| Containment Force Top | lb | 9-22 lb | 14.0 | 13.1 | 12.5 |
| Containment Force Middle | lb | 9-22 lb | 14.9 | 15.7 | 15.0 |
| Containment Force Bottom | lb | 9-22 lb | 13.5 | 13.9 | 13.3 |

Perimeter Measurement Method

Figure 16A:
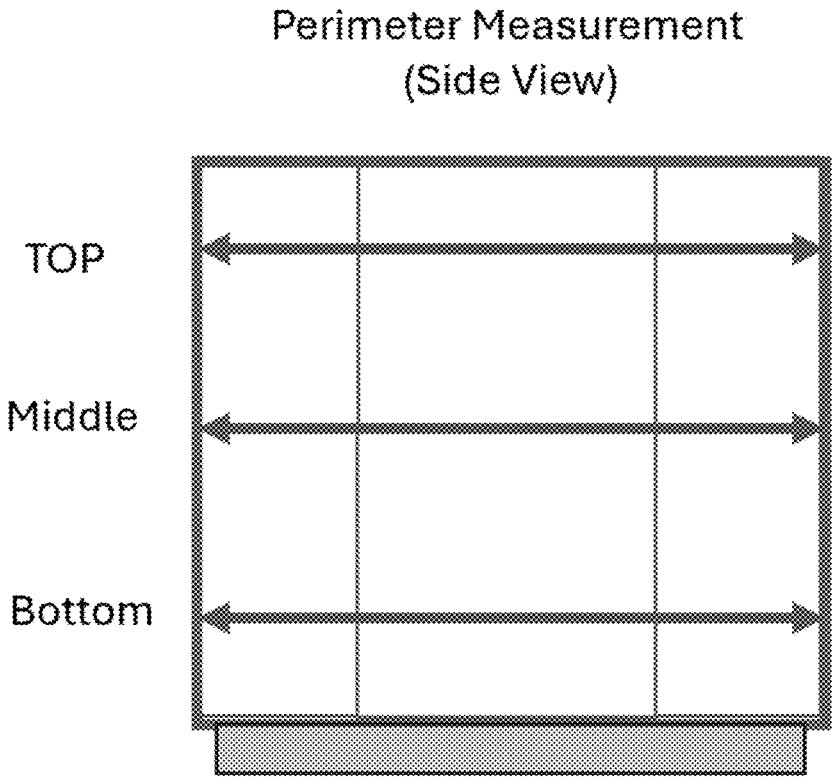
FIGS. 16A and 16B are respective side and top views of the stack on a pallet employed in measuring a perimeter of the stack in the Perimeter Measurement Method.
Figure 16B:
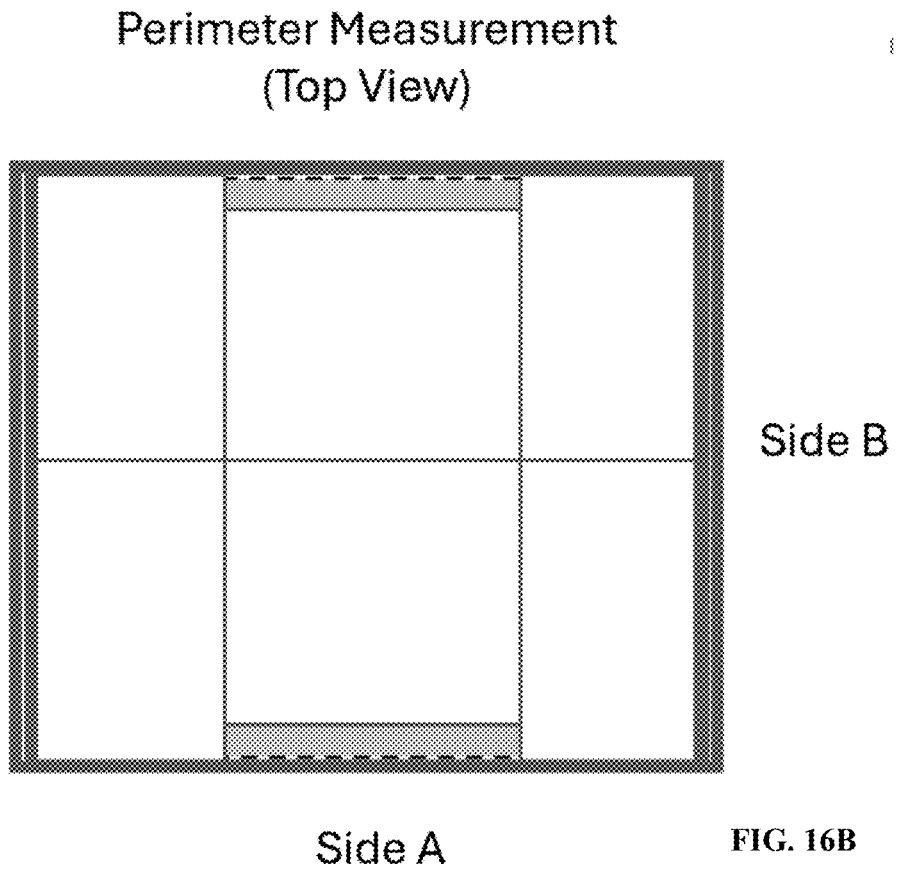

To measure the perimeter of a stack of product containers on a pallet, arrange the desired amount of product on a shipping pallet following the predefined pallet pattern. Products can fit on the pallet symmetrically or asymmetrically. Product arranged on the pallet may be underhung from the edge of the pallet, overhung from the edge of the pallet, or flush with the edge of the pallet. Using a length measuring device (i.e. measuring tape), wrap it around the perimeter of the product arranged on the pallet. Ensure that when taking the measurement, the measuring tape is pulled taut, oriented parallel to the pallet, and is not twisted on itself at the time of reading the measurement. Read the measuring device and record the perimeter value to the nearest $1/16^{th}$ of an inch. Measurements are made at three different vertical locations; the top, middle, and bottom of the load height. (See FIGS. 16A and 16B). The perimeter of the product on the pallet is measured in the same locations both before applying a compressive force to obtain an initial perimeter measurement and after applying a compressive force to obtain a compressed perimeter measurement.

Repeat this procedure for at least 5 replicate pallets of product. Perimeter values are reported individually for the top, middle, and bottom locations on the load before and after application of a compressive force. Calculate the average of the measurements of the top, middle, and bottom recorded perimeter values and report the average perimeter at each location, from both the initial and compressed states, to the nearest $1/16^{th}$ of an inch.

Stack Measurement Method

To measure the maximum and minimum widths and lengths of a stack of product containers on a pallet, arrange the desired amount of product on a shipping pallet following the predefined pallet pattern. Products can fit on the pallet symmetrically or asymmetrically. Product arranged on the pallet may be underhung from the edge of the pallet, overhung from the edge of the pallet, or flush with the edge of the pallet.

Using a 48" long level, place it in contact with Side A. Take a second 48" long level and place it in contact with Side D, opposite side A (See FIGS. 17A and 17B). Ensure that both 48" long levels are parallel and square to each other, oriented vertically and perpendicular to the pallet on which the product is placed. Using a length measurement device (i.e. measuring tape), measure the distance between the 48" long levels on pallet Side A and pallet Side D. Measure at different locations along the sides until the maximum and minimum widths are identified. Record these values as the maximum and minimum widths to the nearest $1/16^{th}$ of an inch.

Figure 17A:
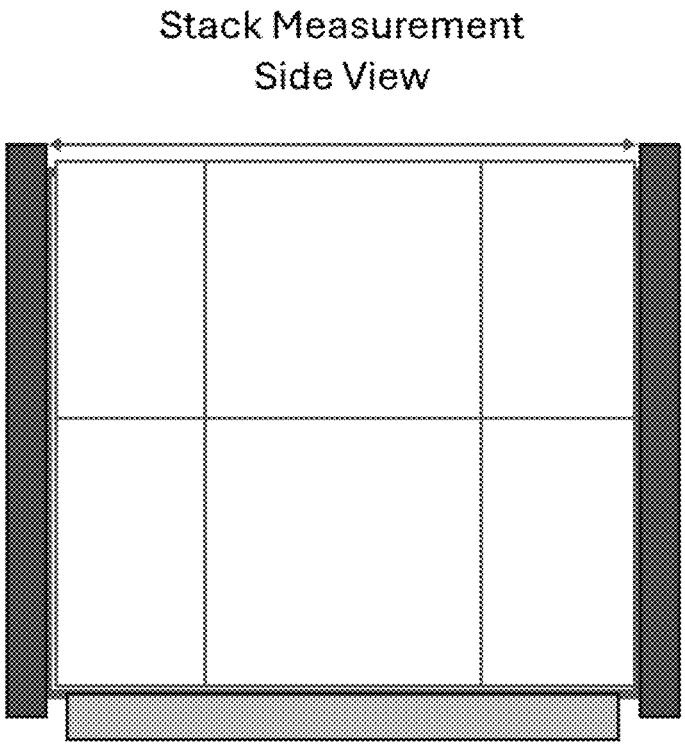
FIGS. 17A and 17B are respective side and top views of the stack on a pallet employed in measuring a length and width of the stack in the Stack Measurement Method.
Figure 17B:
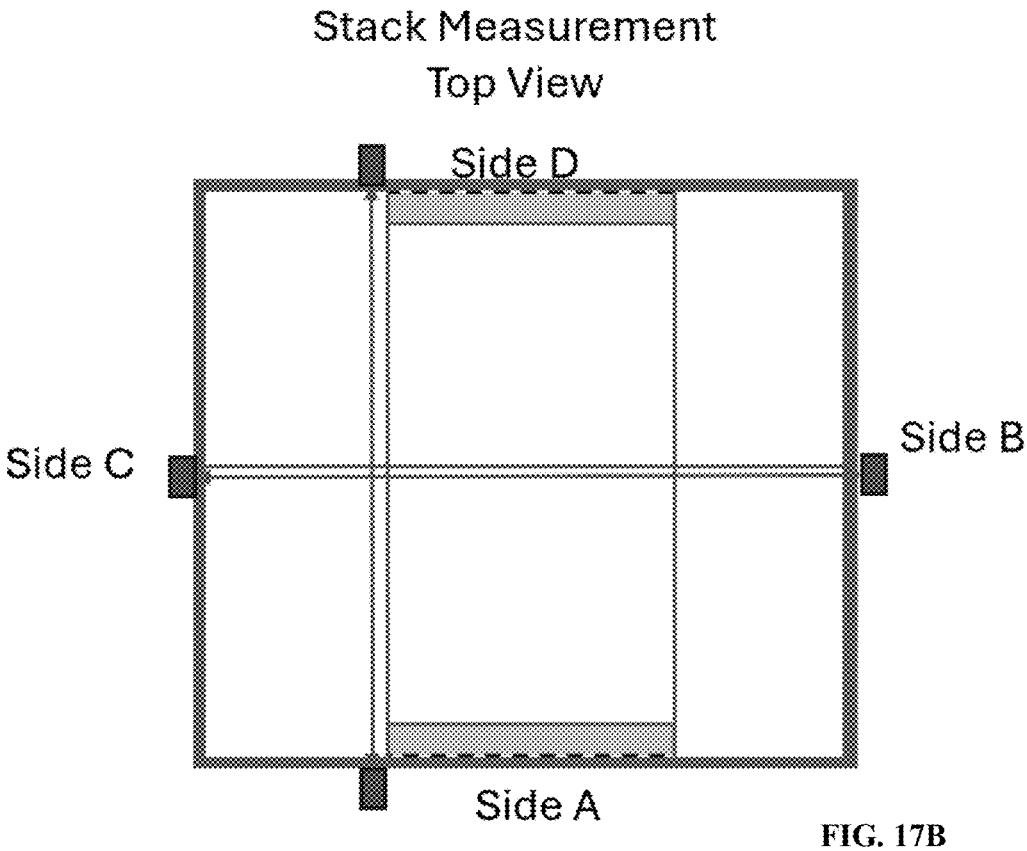

Repeat this process on the other pair of sides, B and C (See FIGS. 17A and 17B). Measure and record these values as the maximum and minimum lengths to the nearest $1/16^{th}$ of an inch.

The maximum and minimum lengths and widths of the product on the pallet are measured both before applying a compressive force to obtain an initial length and width measurements and after applying a compressive force to obtain a compressed length and width measurements.

To characterize the curvature of the unit load, calculate the difference between the maximum and minimum lengths and record this value as the Length Curvature. Additionally, calculate the difference between the maximum and minimum widths and record this value as the Width Curvature. Perform this calculation on the values obtained before application of a compressive force and separately on the values obtained after application of a compressive force.

Repeat this procedure for at least 5 replicate pallets of product. Calculate the average of the measurements and report the values of maximum length, minimum length, maximum width, minimum width, length curvature, and width curvature, from both the initial and compressed state, to the nearest $1/16^{th}$ of an inch.

The Stack Measurement Method may additionally be used in the same manner to measure dimensions of the stack after removal of an applied compressive force to assess the extent of recovery relative to the initial dimensions of the stack before application of the compressive force.

Containment Force Measurement Method

The Containment Force is a measurement of the cumulative force from the layers of film wrapped around a load of containers using tension as a "hugging" force at a given point on the unit load. The Containment Force is measured using the CFT-6 tool, available from Lantech®, Jeffersontown, KY, or an equivalent. The CFT-6 tool is to be calibrated and operated according to the manufacturer's instructions, with the exception of any deviations described below.

The CFT-6 tool's positioning cable is used to identify the horizontal position, approximately 559 mm (22") from the corner of the load, at which the measurement is to be made. Measurements are by default to be made on the short side of the load at three different vertical locations; the top, middle, and bottom of the load height. For loads with void spaces 230 on the short side, measuring on the long side of the pallet, or in a region without a void space is recommended, so that the tool's position indicator is resting on a firm surface of the load.

Once the horizontal and vertical position of the measurement is identified the piercing finger rod is pushed through all layers of film at that location, and the entire piercing finger is fully inserted vertically between the layers of film and the underlying containers. Such that the film covers all but approximately 6 mm (0.25") of the top of the piercing finger, and the film layers are now located between the piercing finger and a parallel fulcrum finger rod. Care should be taken to avoid piercing the underlying containers, and slight deviations in the horizontal positioning are allowed to identify the optimal location (e.g., piercing the film in between the gap created where two rolled products meet).

A force gauge scale is attached by a scale lever to the finger rods. The scale is slowly pulled to the left in the horizontal direction with care to keep it straight and in parallel to the floor applying tension to the film between the piercing finger and the fulcrum finger until the green stripe on the position indicator shows in the slot, and then the tension is released on the scale. The scale is programmed to display the peak force value in pounds and is recorded as the Containment Force to the nearest 0.1 pounds of force.

Repeat this procedure for at least 5 replicate pallets of product. Containment Force values are reported individually for the top, middle, and bottom locations on the load. Calculate the average of the top, middle, and bottom recorded containment force values and report the average containment force at each location to the nearest 0.1 pounds of force.

Product Compressibility Measurement Method

Figure 18:
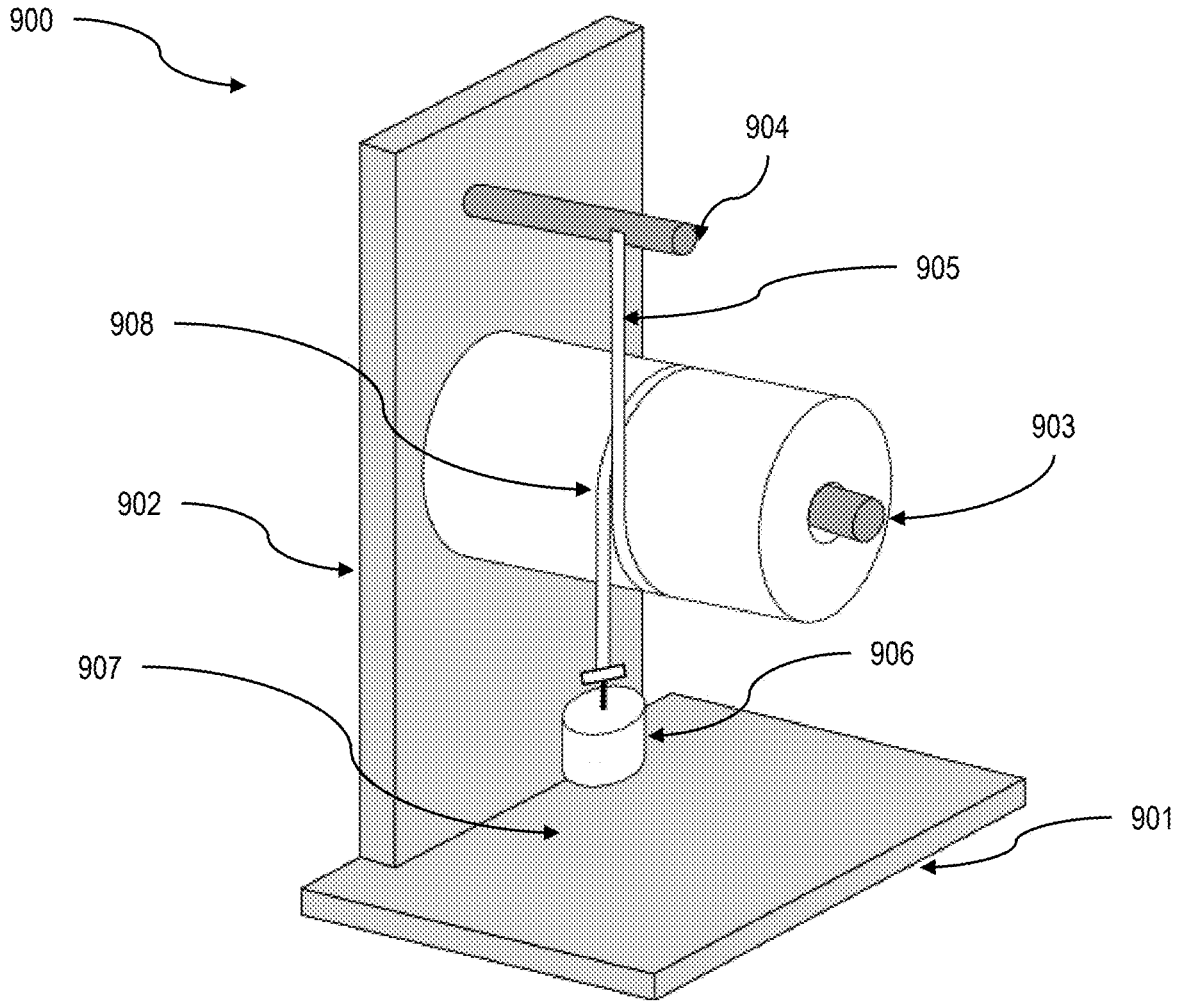
FIG. 18 is a perspective view of a roll diameter tester used to measure product compressibility in the Product Compressibility Measurement Method.

Percent Roll Compressibility (Percent Compressibility) is determined using the Roll Diameter Tester 900 as shown in FIG. 18. It is comprised of a support stand made of two aluminum plates, a base plate 901 and a vertical plate 902 mounted perpendicular to the base, a sample shaft 903 to mount the test roll, and a bar 904 used to suspend a precision diameter tape 905 that wraps around the circumference of the test roll. Two different weights 906 and 907 are suspended from the diameter tape to apply a confining force during the uncompressed and compressed measurement. All testing is performed in a conditioned room maintained at about 23° C.±2° C.° and about 50%+2% relative humidity.

The diameter of the test roll is measured directly using a Pi® tape or equivalent precision diameter tape (e.g. an Executive Diameter tape available from Apex Tool Group, LLC, Apex, NC, Model No. W606PD) which converts the circumferential distance into a diameter measurement so the roll diameter is directly read from the scale. The diameter tape is graduated to 0.01 inch increments with accuracy certified to 0.001 inch and traceable to NIST. The tape is 0.25 in wide and is made of flexible metal that conforms to the curvature of the test roll but is not elongated under the 1100 g loading used for this test. If necessary the diameter tape is shortened from its original length to a length that allows both of the attached weights to hang freely during the test, yet is still long enough to wrap completely around the test roll being measured. The cut end of the tape is modified to allow for hanging of a weight (e.g. a loop). All weights used are calibrated, Class F hooked weights, traceable to NIST.

The aluminum support stand is approximately 600 mm tall and stable enough to support the test roll horizontally throughout the test. The sample shaft 903 is a smooth aluminum cylinder that is mounted perpendicularly to the vertical plate 902 approximately 485 mm from the base. The shaft has a diameter that is at least 90% of the inner diameter of the roll and longer than the width of the roll. A small steal bar 904 approximately 6.3 mm diameter is mounted perpendicular to the vertical plate 902 approximately 570 mm from the base and vertically aligned with the sample shaft. The diameter tape is suspended from a point along the length of the bar corresponding to the midpoint of a mounted test roll. The height of the tape is adjusted such that the zero mark is vertically aligned with the horizontal midline of the sample shaft when a test roll is not present.

Condition the samples at about 23° C.±2° C. and about 50%+2% relative humidity for 2 hours prior to testing. Rolls with cores that are crushed, bent or damaged should not be tested. Place the test roll on the sample shaft 903 such that the direction the paper was rolled onto its core is the same direction the diameter tape will be wrapped around the test roll. Align the midpoint of the roll's width with the suspended diameter tape. Loosely loop the diameter tape 904 around the circumference of the roll, placing the tape edges directly adjacent to each other with the surface of the tape lying flat against the test sample. Carefully, without applying any additional force, hang the 100 g weight 906 from the free end of the tape, letting the weighted end hang freely without swinging. Wait 3 seconds. At the intersection of the diameter tape 908, read the diameter aligned with the zero mark of the diameter tape and record as the Original Roll Diameter to the nearest 0.01 inches. With the diameter tape still in place, and without any undue delay, carefully hang the 1000 g weight 907 from the bottom of the 100 g weight, for a total weight of 1100 g. Wait 3 seconds. Again read the roll diameter from the tape and record as the Compressed Roll Diameter to the nearest 0.01 inch. Calculate percent compressibility to the according to the following equation and record to the nearest 0.1%:

$$\% \text{ Compressibility} = \frac{(\text{Orginal Roll Diameter}) - (\text{Compressed Roll Diameter})}{\text{Original Roll Diameter}} \times 100$$

Repeat the testing on 10 replicate rolls and record the separate results to the nearest 0.1%. Average the 10 results and report as the Percent Compressibility to the nearest 0.1%.

Aspects of the Invention

Each of the Aspects of the Invention of U.S. Pub. No. 2025-0376286, including the Aspects of paragraphs [0129] through [0217], are incorporated herein by reference.

Further Definitions and Cross-References

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for increasing unit load efficiency, the method comprising:

providing a unit load comprising a pallet and a stack disposed on the pallet, the pallet having a pallet length along a pallet longitudinal axis and a pallet width along a pallet lateral axis, the stack comprising a plurality of packages, the stack having an initial maximum stack length along the pallet longitudinal axis and an initial maximum stack width along the pallet lateral axis, wherein the initial maximum stack length and the initial maximum stack width are measured; and applying a force to the stack to reduce one or more of the initial maximum stack length to a compressed maximum stack length along the pallet longitudinal axis and the initial maximum stack width to a compressed maximum stack width along the pallet lateral axis, wherein the compressed maximum stack length and the compressed maximum stack width are measured, wherein one or more of the compressed maximum stack length is from about 1% to about 10% greater than the pallet length and the compressed maximum stack width is from about 1% to about 15% greater than the pallet width.

2. The method according to claim 1, wherein the method further comprises wrapping the stack with an elastically deformable substrate.

3. The method according to claim 1, wherein the step of applying the force comprises wrapping the stack with an elastically deformable substrate.

4. The method according to claim 1, wherein the compressed maximum stack width is from about 2% to about 14% greater than the pallet width.

5. The method according to claim 1, wherein the pallet length is about 48 inches (121.92 cm), wherein the pallet width is about 40 inches (101.6 cm), wherein the compressed maximum stack length is less than or equal to about 49.5 inches (125.73 cm), and wherein the compressed maximum stack width is less than or equal to about 43.5 inches (110.49 cm).

6. The method according to claim 1, wherein the stack comprises 10 to 60 packages.

7. The method according to claim 1, wherein forming the stack on the pallet comprises arranging the plurality of packages in a plurality of layers.

8. The method according to claim 1, wherein each of the plurality of packages has a package length along a package longitudinal axis and a package width along a package lateral axis, wherein the package length is greater than the package width.

9. The method according to claim 8, wherein the plurality of packages comprises at least a first package and a second package, and wherein forming the stack on the pallet comprises substantially aligning the package longitudinal axis of the first package with the pallet longitudinal axis and substantially aligning the package lateral axis of the second package with the pallet lateral axis.

10. The method according to claim 2, wherein the method is calibrated to allow one or more of the compressed maximum stack length and the compressed maximum stack width to return to within 95% to 100% of the initial maximum stack length and the initial maximum stack width, respectively, upon removal of the elastically deformable substrate.

11. The method according to claim 2, wherein the initial maximum stack length is reduced to the compressed maximum stack length and wherein the method is calibrated to allow the compressed maximum stack length to return to within 95% to 100% of the initial maximum stack length upon removal of the elastically deformable substrate.

12. The method according to claim 2, wherein the initial maximum stack width is reduced to the compressed maximum stack width and wherein the method is calibrated to allow the compressed maximum stack width to return to within 95% to 100% of the initial maximum stack width upon removal of the elastically deformable substrate.

13. The method according to claim 2, wherein each of the plurality of packages comprises a plurality of rolled paper products having a compressibility in a range from about 13% to about 15%, and wherein the compressibility of the rolled paper products is measured.

14. The method according to claim 13, wherein the plurality of packages comprise at least a first package and a second package, and wherein forming the stack on the pallet comprises offsetting the plurality of rolled paper products of the first package relative to the plurality of rolled paper products of the second package to form at least one offset zone.

15. The method according to claim 13, wherein wrapping the stack with the elastically deformable substrate under the force does not compress any of the plurality of rolled paper products beyond a point at which the rolled paper products are permanently crushed.

16. The method according to claim 3, wherein the stack comprises:

outer surfaces along top and bottom ends of the stack, wherein the top and bottom ends of the stack are spaced apart along a longitudinal axis of the stack;

outer surfaces along left and right sides of the stack, wherein the left and right sides of the stack are spaced apart along the pallet lateral axis;

wherein the wrapping step comprises forming, with the elastically deformable substrate, an arc along one or more of:

the outer surfaces along the top and bottom ends of the stack, based on a compressed stack length having a greater value between the left and right sides of the stack than at the left and right sides of the stack; and the outer surfaces along the left and right sides of the stack, based on a compressed stack width having a greater value between the top and bottom ends of the stack than at the top and bottom ends of the stack.

17. The method according to claim 16, wherein one or more of:

the arc is formed along the outer surfaces along the top and bottom ends of the stack based on the compressed stack length having the greater value at a midpoint between the left and right sides of the stack; and the arc is formed along the outer surfaces along the left and right sides of the stack based on the compressed stack width having the greater value at a midpoint between the top and bottom ends of the stack.

18. The method according to claim 16, wherein the arc is formed along the outer surfaces along the top and bottom ends of the stack based on the compressed stack length having a maximum value in a range from about 43 inches to about 51 inches between the left and right sides of the stack and a minimum value in a range from about 40 inches to about 50 inches between the left and right sides of the stack.

19. The method according to claim 18, wherein the arc is formed along the outer surfaces along the left and right sides of the stack based on the compressed stack width having a maximum value in a range from about 38 inches to about 46 inches between the top and bottom ends of the stack and a minimum value in a range from about 34 inches to about 44 inches between the top and bottom ends of the stack.

20. The method according to claim 3, wherein the wrapping step further comprises wrapping the stack and the pallet with the elastically deformable substrate such that the elastically deformable substrate engages a portion of a height of the pallet, wherein the height of the pallet is defined between a bottom surface of the pallet and a top surface of the pallet on which the stack is disposed and wherein the portion of the height extends from the top surface of the pallet.

* * * * *